US008939808B2

(12) United States Patent
Kyuno et al.

(10) Patent No.: US 8,939,808 B2
(45) Date of Patent: Jan. 27, 2015

(54) METHOD AND DEVICE FOR MANUFACTURING SPARK PLUG

(75) Inventors: Jiro Kyuno, Kiyosu (JP); Keiji Ozeki, Konan (JP); Tomoaki Kato, Nagoya (JP); Akiko Maruno, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 155 days.

(21) Appl. No.: 13/880,088

(22) PCT Filed: Nov. 11, 2011

(86) PCT No.: PCT/JP2011/076053

§ 371 (c)(1), (2), (4) Date: Apr. 18, 2013

(87) PCT Pub. No.: WO2012/070409

PCT Pub. Date: May 31, 2012

(65) Prior Publication Data

US 2013/0225029 A1 Aug. 29, 2013

(30) Foreign Application Priority Data

Nov. 22, 2010 (JP) ..... 2010-259631

(51) Int. Cl.

*H01T 21/02* (2006.01)
*H01T 13/36* (2006.01)
*H01T 21/00* (2006.01)

(52) U.S. Cl.

CPC ..... *H01T 21/02* (2013.01); *H01T 13/36* (2013.01)
USPC ..... 445/7; 313/125; 445/63

(58) Field of Classification Search

USPC ..... 445/7, 63, 64; 313/118–145
See application file for complete search history.

(56) References Cited

U.S. PATENT DOCUMENTS

| | | | | |
|---|---|---|---|---|
| 2,111,916 | A * | 3/1938 | Middleton | 174/152 S |
| 3,609,837 | A | 10/1971 | Bretsch | 455/7 |
| 2002/0193033 | A1 * | 12/2002 | Nasu et al. | 445/7 |

(Continued)

FOREIGN PATENT DOCUMENTS

| | | | |
|---|---|---|---|
| JP | 48-26687 | 8/1973 | |
| JP | 2003/0168954 | 9/2003 | H01T 13/36 |
| JP | 2006-092955 | 4/2006 | H01T 13/36 |

(Continued)

OTHER PUBLICATIONS

International Search Report for International Application No. PCT/JP2011/076053, Feb. 14, 2012.

*Primary Examiner* — Karabi Guharay
*Assistant Examiner* — Nathaniel Lee
(74) *Attorney, Agent, or Firm* — Kusner & Jaffe

(57) ABSTRACT

A spark plug includes a ceramic insulator extending in the direction of an axis (CL1) and a metallic shell provided around the ceramic insulator. Talc is pressed charged between the ceramic insulator and the metallic shell and a crimp portion is formed for fixing the metallic shell and the ceramic insulator while the metallic shell having the ceramic insulator inserted thereinto is supported by a tubular receiving member. The receiving member is made movable in relation to a pressing jig in its radial direction. Thus, at the time of pressing of the talc, etc., the eccentricity between the center axis (CL2), (CL3) of the pressing jig and the axis (CL1) in the radial direction can be reduced, whereby the misalignment between the axis (CL1) and the center axis of the metallic shell or the like assembly error can be suppressed.

21 Claims, 20 Drawing Sheets

(56) References Cited

U.S. PATENT DOCUMENTS

| | | | | |
|---|---|---|---|---|
| 2003/0168954 | A1* | 9/2003 | Suzuki | 313/141 |
| 2010/0203791 | A1* | 8/2010 | Suzuki et al. | 445/7 |

FOREIGN PATENT DOCUMENTS

| | | | |
|---|---|---|---|
| JP | 2006-236906 | 9/2006 | H01T 13/20 |
| JP | 2010-212230 | 9/2010 | H01T 21/02 |

* cited by examiner (a)

(b)

(a)

(b)

(a)

(b)

(a)

(b)

METHOD AND DEVICE FOR MANUFACTURING SPARK PLUG

FIELD OF THE INVENTION

The present invention relates to a method and device for manufacturing a spark plug used for an internal combustion engine or the like.

BACKGROUND OF THE INVENTION

A spark plug is attached to, for example, an internal combustion engine (engine), and is used for igniting an air-fuel mixture within a combustion chamber. In general, such a spark plug includes a tubular insulator extending in the direction of an axis; a center electrode inserted into the insulator; a metallic shell provided around the insulator; and a ground electrode provided at a forward end portion of the metallic shell and forming a spark discharge gap in cooperation with the center electrode. The metallic shell and the insulator are fixed together by inserting the insulator into the metallic shell and applying a load along the direction of the axis to a rear end opening portion of the metallic shell through use of a predetermined die to thereby bend the rear end opening portion inward in the radial direction (i.e., through a crimping step).

Further, there has been known a technique of disposing talc between the metallic shell and the insulator in order to enhance the airtightness between the metallic shell and the insulator (see, for example, Japanese Patent Application Laid-Open (kokai) No. 2006-92955 "Patent Document 1").

Problems to be Solved by the Invention

When talc is disposed between the metallic shell and the insulator in order to more reliably enhance the airtightness therebetween, it is preferred to press the talc to thereby increase the charging density of the talc. A conceivable method of pressing talc is as follows. In a state in which a metallic shell including an insulator inserted thereinto is supported by a tubular receiving member, talc is charged between the metallic shell and the insulator. Subsequently, after the axis of the insulator is aligned with the center axis of a talc pressing jig, the talc pressing jig is moved downward along the direction of the axis such that the talc is pressed by a forward end portion of the talc pressing jig.

However, there is a possibility that misalignment (eccentricity) occurs between the center axis of the talc pressing jig and the axis of the insulator, for example, when the screws fixing the receiving member become loose. If the talc is pressed in a state in which the center axis of the talc pressing jig and the axis of the insulator are eccentric to each other, the radially inward force applied to the outer circumferential surface of the insulator via the talc becomes nonuniform along the circumferential direction of the insulator, with the resultant possibility that the axis of the insulator deviates or inclines from the center axis of the receiving member (i.e., the center axis of the metallic shell). In such a case, an excessively large stress acts on the insulator and breakage (cracking or the like) of the insulator occurs. Also, the misalignment, etc. of the insulator causes misalignment, etc. of the center electrode held thereby so that anomalous spark discharge (e.g., lateral spark) becomes more likely to occur between the center electrode and the metallic shell. In particular, in the case of a spark plug in which the distance between the center electrode and the metallic shell measured in the radial direction is decreased to a relative small value so as to meet the requirement for miniaturization, even when the misalignment or inclination of the axis of the insulator is slight, anomalous spark discharge may be generated.

Notably, the above-mentioned misalignment between the center axis of the metallic shell and the axis of the insulator or the like assembly error may also occur when a load along the direction of the axis is applied to the rear end opening portion of the metallic shell in the above-described crimping step.

The present invention has been accomplished in view of the above-described problem, and its object is to provide a method and apparatus for manufacturing a spark plug which can reduce the eccentricity between the center axis of a pressing jig and the axis of an insulator in the radial direction in a talc pressing step and/or in a crimping step, to thereby effectively suppress the misalignment between the axis of the insulator and the center axis of the metallic shell or the like assembly error.

SUMMARY OF THE INVENTION

Configurations suitable for achieving the above object will next be described in itemized form. If needed, actions and effects peculiar to the configurations will be additionally described.

Configuration 1. A method for manufacturing a spark plug of the present configuration is used for manufacturing a spark plug comprising:

a tubular insulator extending in the direction of an axis;

a tubular metallic shell provided around the insulator; and talc charged between the insulator and the metallic shell, the method being characterized by comprising:

a talc pressing step of pressing the talc along the direction of the axis using a tubular talc pressing jig in a state in which the metallic shell having the insulator inserted thereinto is supported by a tubular receiving member, wherein the receiving member is made movable in relation to the talc pressing jig in the radial direction of the receiving member at least when the talc is pressed by the talc pressing jig; and the talc pressing step includes an eccentricity adjusting step of reducing an eccentricity between a center axis of the talc pressing jig and the axis of the insulator in the radial direction.

According to configuration 1 mentioned above, the receiving member is made movable in relation to the talc pressing jig in its radial direction at least when the talc is pressed by a talc pressing jig. Accordingly, even in the case where a slight misalignment is present between the center axis of the talc pressing jig and the axis of the insulator when the talc is pressed, the center axis of the talc pressing jig and the axis of the insulator are accurately aligned with each other through relative movement of the receiving member (namely, the eccentricity between the center axis of the talc pressing jig and the axis of the insulator in the radial direction decreases). Accordingly, when the talc is pressed, the radially inward force applied to the outer circumferential surface of the insulator via the talc becomes uniform along the circumferential direction of the insulator. As a result, the misalignment and/or inclination between the axis of the insulator and the center axis of the metallic shell can be effectively suppressed, whereby breakage of the insulator and generation of anomalous discharge can be prevented.

Configuration 2. A method for manufacturing a spark plug of the present configuration is characterized in that in configuration 1 mentioned above, the receiving member is supported by a stationary base disposed around the receiving member, via a plurality of elastic members provided between the receiving member and the stationary base; and an annular gap is formed between an outer circumferential surface of the receiving member and an inner circumferential surface of the stationary base such that the receiving member is movable in relation to the stationary base in the radial direction of the receiving member.

According to configuration 2 mentioned above, an annular gap is formed between the outer circumferential surface of the receiving member and the inner circumferential surface of the stationary base such that the receiving member is movable in relation to the stationary base in the radial direction of the receiving member. Accordingly, an action and an effect similar to those provided by the above-described configuration 1 can be provided, and the misalignment and/or inclination between the axis of the insulator and the center axis of the metallic shell can be effectively suppressed.

Also, since the receiving member is supported on the stationary base via the elastic members, unless an external force acts on the receiving member, the receiving member and the stationary base basically maintain the fixed positional relation therebetween. Namely, even when the receiving member moves in relation to the stationary base at the time of pressing of the talc, the receiving member returns to its original position after the pressing of the talc. Accordingly, it is possible to more reliably prevent the operation of aligning the center axis of the talc pressing jig with the axis of the insulator at the time of pressing of the talc from influencing a talc pressing step subsequently performed.

Configuration 3. A method for manufacturing a spark plug of the present configuration is characterized in that in configuration 1 or 2 mentioned above, in the spark plug, the insulator and the metallic shell are fixed together by a crimp portion provided at a rear end portion of the metallic shell and bent inward in the radial direction; and the method further comprises a crimping step which is performed after the talc pressing step so as to press the rear end portion of the metallic shell along the direction of the axis using a tubular shell pressing jig to thereby form the crimp portion, wherein, in the crimping step, the crimp portion is formed through use of the shell pressing jig in a state in which the metallic shell having the insulator inserted thereinto is supported by the receiving member, which is made movable in relation to the shell pressing jig in the radial direction of the receiving member at least when the metallic shell is pressed by the shell pressing jig.

According to configuration 3 mentioned above, the receiving member is made movable in relation to the shell pressing jig in its radial direction. Therefore, when the metallic shell is pressed by the shell pressing jig, the center axis of the shell pressing jig and the axis of the insulator are accurately aligned with each other. Accordingly, when the crimp portion is formed, the radially inward force applied to the outer circumferential surface of the metallic shell becomes uniform along the circumferential direction of the metallic shell. As a result, the misalignment and/or inclination between the axis of the insulator and the center axis of the metallic shell can be suppressed more effectively, whereby breakage of the insulator and generation of anomalous discharge can be more reliably prevented.

Configuration 4. A method for manufacturing a spark plug of the present configuration is characterized in that in any one of configurations 1 to 3 mentioned above, in the talc pressing step, a forward end portion of the insulator is held so as to restrain radial movement of the forward end portion of the insulator in relation to the receiving member.

According to configuration 4 mentioned above, in the talc pressing step, radial movement of the forward end portion of the insulator in relation to the receiving member is restrained. Accordingly, the axis of the insulator and the center axis of the metallic shell supported by the receiving member can be aligned with each other very accurately, whereby the misalignment and/or inclination between the axis of the insulator and the center axis of the metallic shell can be suppressed more effectively. When misalignment or the like occurs at the forward end portion of the insulator, anomalous discharge becomes more likely to occur. According to the above-described configuration 4, occurrence of the misalignment or the like at the forward end portion of the insulator can be suppressed quite effectively. As a result, generation of anomalous discharge can be more reliably prevented.

In the case where a receiving member which cannot move relatively is used and the forward end portion of the insulator is held, the following problem occurs. When the talc is pressed in a state in which the center axis of the talc pressing jig and the axis of the insulator are not aligned, a stress produced as a result of the misalignment concentrates on the insulator, and the insulator may be broken. In contrast, the case where a receiving member which can move relatively is used (namely, the above-described configuration 1, etc. is employed), the stress acting on the insulator can be reduced despite that the forward end portion of the insulator is held, and breakage of the insulator can be more reliably prevented. In other words, the above-described configuration 1, etc. exhibit the effect of suppressing the misalignment between the axis of the insulator and the center axis of the metallic shell or the like assembly error. In addition, in the case where the effect of suppressing the misalignment, etc. is further enhanced through employment of the above-described configuration 4, the above-described configuration 1, etc. exhibits an effect of preventing breakage of the insulator which would otherwise occur as a result of employment of the above-described configuration 4.

Configuration 5. A method for manufacturing a spark plug of the present configuration is characterized in that in any one of configurations 1 to 4 mentioned above, in the talc pressing step, the receiving member is held until at least a portion of the insulator enters an inner space of the talc pressing jig.

Notably, the expression "the receiving member is held" encompasses not only the case where the receiving member is held in a state in which the receiving member does not move even when an external force is applied to the receiving member, but also the case where the receiving member is held in a state in which the receiving member does not move unless a large external force is applied to the receiving member (the receiving member moves when a large external force is applied to the receiving member) (this applies to the following description). Accordingly, the receiving member may be held by the elastic members as in the above-described configuration 2.

As described above, from the viewpoint of suppressing the misalignment between the axis of the insulator and the center axis of the metallic shell or the like assembly error, it is preferred to make the receiving member relatively movable in its radial direction at least when the talc is pressed by the talc pressing jig. However, if the receiving member can move freely when the talc pressing jig approaches the talc, the axis of the insulator may greatly deviate from the center axis of the talc pressing jig as a result of movement of the receiving member. In such a case, the forward end surface of the talc pressing jig collides with the insulator or the terminal electrode exposed from the rear end of the insulator, which may lead to damage to the insulator or the terminal electrode.

In contrast, according to the above-described configuration 5, until at least a portion of the insulator enters the inner space of the talc pressing jig, the receiving member is held such that the receiving member cannot move freely. Accordingly, the situation in which the axis of the insulator greatly deviates from the center axis of the talc pressing jig can be prevented more reliably, and collision of the talc pressing jig against the insulator or the terminal electrode can be prevented. As a result, damage to the insulator and the terminal electrode can be more reliably prevented.

Configuration 6. A method for manufacturing a spark plug of the present configuration is used for manufacturing a spark plug comprising:

a tubular insulator extending in the direction of an axis;

a tubular metallic shell provided around the insulator; and the insulator and the metallic shell being fixed together by a crimp portion provided at a rear end portion of the metallic shell and bent inward in the radial direction, the method being characterized by comprising:

a crimping step of pressing the rear end portion of the metallic shell along the direction of the axis using a tubular shell pressing jig in a state in which the metallic shell having the insulator inserted thereinto is supported by a tubular receiving member, wherein the receiving member is made movable in relation to the shell pressing jig in the radial direction of the receiving member at least when the metallic shell is pressed by the shell pressing jig; and the crimping step includes an eccentricity adjusting step of reducing an eccentricity between a center axis of the shell pressing jig and the axis of the insulator in the radial direction.

According to configuration 6 mentioned above, even in the case where a slight misalignment is present between the center axis of the shell pressing jig and the axis of the insulator when the metallic shell is pressed, the center axis of the shell pressing jig and the axis of the insulator are accurately aligned with each other through relative movement of the receiving member in relation to the shell pressing jig (namely, the eccentricity between the center axis of the shell pressing jig and the axis of the insulator in the radial direction decreases). Accordingly, when the metallic shell is pressed, the radially inward force applied to the outer circumferential surface of the metallic shell becomes uniform along the circumferential direction of the metallic shell. As a result, the misalignment and/or inclination between the axis of the insulator and the center axis of the metallic shell can be effectively suppressed, whereby breakage of the insulator and generation of anomalous discharge can be more reliably prevented.

Configuration 7. A method for manufacturing a spark plug of the present configuration is characterized in that in configuration 6 mentioned above, the receiving member is supported by a stationary base provided around the receiving member, via a plurality of elastic members provided between the receiving member and the stationary base; and an annular gap is formed between an outer circumferential surface of the receiving member and an inner circumferential surface of the stationary base such that the receiving member is movable in relation to the stationary base in the radial direction of the receiving member.

According to configuration 7 mentioned above, an annular gap is formed between the outer circumferential surface of the receiving member and the inner circumferential surface of the stationary base such that the receiving member is movable in relation to the stationary base in the radial direction of the receiving member. Accordingly, an action and an effect similar to those provided by the above-described configuration 6 can be provided, and the misalignment and/or inclination between the axis of the insulator and the center axis of the metallic shell can be effectively suppressed.

Also, since the receiving member is supported on the stationary base via the elastic members, unless an external force acts on the receiving member, the receiving member and the stationary base basically maintain the fixed positional relation therebetween. Namely, even when the receiving member moves in relation to the stationary base at the time of pressing of the metallic shell, the receiving member returns to its original position after the pressing of the metallic shell. Accordingly, it is possible to more reliably prevent the operation of aligning the center axis of the shell pressing jig with the axis of the insulator at the time of pressing of the metallic shell from influencing a crimping step which is subsequently performed.

Configuration 8. A method for manufacturing a spark plug of the present configuration is characterized in that in configuration 3 or 6 mentioned above, in the crimping step, a forward end portion of the insulator is held so as to restrain radial movement of the forward end portion of the insulator in relation to the receiving member.

According to configuration 8 mentioned above, in the crimping step, an action and an effect similar to those provided by the above-described configuration 4 are provided.

Configuration 9. A method for manufacturing a spark plug of the present configuration is characterized in that in configuration 3, 5, or 7 mentioned above, in the crimping step, the receiving member is held until at least a portion of the insulator enters an inner space of the shell pressing jig.

According to configuration 9 mentioned above, in the crimping step, collision of the shell pressing jig against the insulator or the terminal electrode can be prevented more reliably, and damage to the insulator and the terminal electrode can be more reliably prevented.

Configuration 10. A device for manufacturing a spark plug of the present configuration is used for manufacturing a spark plug comprising:

a tubular insulator extending in the direction of an axis;

a tubular metallic shell provided around the insulator; and talc charged between the insulator and the metallic shell, the device being characterized by comprising:

a tubular receiving member for supporting the metallic shell; and a tubular talc pressing jig which is movable along the direction of the axis, wherein the talc is pressed by moving the talc pressing jig in a state in which the metallic shell having the insulator inserted thereinto is supported by the receiving member; and the receiving member is made movable in relation to the talc pressing jig in the radial direction of the receiving member at least when the talc is pressed by the talc pressing jig.

According to configuration 10 mentioned above, basically, an action and an effect similar to those provided by the above-described configuration 1 are provided.

Configuration 11. A device for manufacturing a spark plug of the present configuration is characterized in that in configuration 10 mentioned above, a stationary base is disposed around the receiving member; and a plurality of elastic members are provided between the receiving member and the stationary base, wherein an annular gap is formed between an outer circumferential surface of the receiving member and an inner circumferential surface of the stationary base such that the receiving member is movable in relation to the stationary base in the radial direction of the receiving member.

According to configuration 11 mentioned above, basically, an action and an effect similar to those provided by the above-described configuration 2 are provided.

Configuration 12. A device for manufacturing a spark plug of the present configuration is characterized in that in configuration 10 or 11 mentioned above, when the talc pressing jig is moved, the receiving member is held until at least a portion of the insulator enters an inner space of the talc pressing jig.

According to configuration 12 mentioned above, basically, an action and an effect similar to those provided by the above-described configuration 5 are provided.

Configuration 13. A device for manufacturing a spark plug of the present configuration is characterized in that in any one of configurations 10 to 12 mentioned above, in the spark plug, the insulator and the metallic shell are fixed together by a crimp portion provided at a rear end portion of the metallic shell and bent inward in the radial direction; and the manufacturing device further comprises a tubular shell pressing jig which is movable in the direction of the axis, wherein, in a state in which the metallic shell having the insulator inserted thereinto is supported by the receiving member, the shell pressing jig is moved so as to press the rear end portion of the metallic shell to thereby form the crimp portion; and the receiving member is made movable in relation to the shell pressing jig in the radial direction of the receiving member at least when the metallic shell is pressed by the shell pressing jig.

According to configuration 13 mentioned above, basically, an action and an effect similar to those provided by the above-described configuration 3 are provided.

Configuration 14. A device for manufacturing a spark plug of the present configuration is used for manufacturing a spark plug comprising:

a tubular insulator extending in the direction of an axis;

a tubular metallic shell provided around the insulator; and the insulator and the metallic shell being fixed together by a crimp portion provided at a rear end portion of the metallic shell and bent inward in the radial direction, the device being characterized by comprising:

a tubular receiving member for supporting the metallic shell; and a tubular shell pressing jig which is movable along the direction of the axis, wherein, in a state in which the metallic shell having the insulator inserted thereinto is supported by the receiving member, the shell pressing jig is moved so as to press the rear end portion of the metallic shell to thereby form the crimp portion; and the receiving member is made movable in relation to the shell pressing jig in the radial direction of the receiving member at least when the metallic shell is pressed by the shell pressing jig.

According to configuration 14 mentioned above, basically, an action and an effect similar to those provided by the above-described configuration 6 are provided.

Configuration 15. A device for manufacturing a spark plug of the present configuration is characterized in that in configuration 14 mentioned above, a stationary base is disposed around the receiving member; and a plurality of elastic members are provided between the receiving member and the stationary base, wherein an annular gap is formed between an outer circumferential surface of the receiving member and an inner circumferential surface of the stationary base such that the receiving member is movable in relation to the stationary base in the radial direction of the receiving member.

According to configuration 15 mentioned above, basically, an action and an effect similar to those provided by the above-described configuration 7 are provided.

Configuration 16. A device for manufacturing a spark plug of the present configuration is characterized in that in configuration 14 or 15 mentioned above, when the shell pressing jig is moved, the receiving member is held until at least a portion of the insulator enters an inner space of the shell pressing jig.

According to configuration 16 mentioned above, basically, an action and an effect similar to those provided by the above-described configuration 9 are provided.

Configuration 17. A device for manufacturing a spark plug of the present configuration is characterized in that in any of configurations 10 to 16 mentioned above, there is provided an insulator guide which holds a forward end portion of the insulator so as to restrain radial movement of the forward end portion of the insulator in relation to the receiving member.

According to configuration 17 mentioned above, basically, an action and an effect similar to those provided by the above-described configuration 4 are provided.

DETAILED DESCRIPTION OF THE INVENTION

Figure 1:
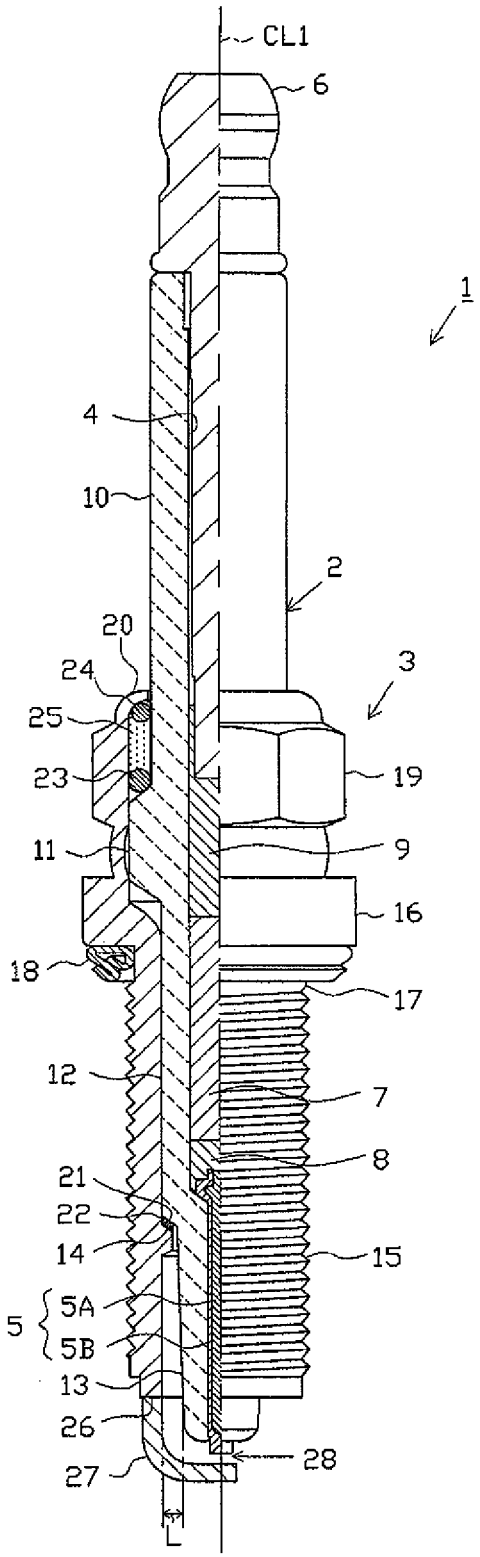
FIG. 1 is a partially sectioned front view showing the structure of a spark plug.

One embodiment of the present invention will next be described with reference to the drawings. FIG. 1 is a partially sectioned front view showing a spark plug 1. In the following description, the direction of an axis CL1 of the spark plug 1 in FIG. 1 is referred to as the vertical direction, and the lower side of the spark plug 1 in FIG. 1 is referred to as the forward end side of the spark plug 1, and the upper side as the rear end side of the spark plug 1.

The spark plug 1 includes a tubular ceramic insulator 2 (corresponding to the insulator in claims), and a tubular metallic shell 3, which holds the ceramic insulator 2.

The ceramic insulator 2 is formed from alumina or the like by firing, as well known in the art. The ceramic insulator 2 externally includes a rear trunk portion 10 formed on the rear end side; a large-diameter portion 11, which is located forward of the rear trunk portion 10 and projects radially outward; an intermediate trunk portion 12, which is located forward of the large-diameter portion 11 and is smaller in diameter than the large-diameter portion 11; and a leg portion 13, which is located forward of the intermediate trunk portion 12 and is smaller in diameter than the intermediate trunk portion 12. Of the ceramic insulator 2, the large-diameter portion 11, the intermediate trunk portion 12, and most of the leg portion 13 are accommodated in the metallic shell 3. A tapered, stepped portion 14 is formed at a connection portion between the intermediate trunk portion 12 and the leg portion 13. The ceramic insulator 2 is engaged with the metallic shell 3 at the stepped portion 14.

The ceramic insulator 2 has an axial hole 4 extending therethrough along the axis CL1. A center electrode 5 is fixedly inserted into a forward end portion of the axial hole 4. The center electrode 5 includes an inner layer 5A formed of copper or copper alloy, and an outer layer 5B formed of an Ni alloy which contains nickel (Ni) as a main component. The center electrode 5 assumes a rodlike (circular columnar) shape as a whole, and its forward end projects from the forward end of the ceramic insulator 2.

A terminal electrode 6 is fixedly inserted into a rear end portion of the axial hole 4 and projects from the rear end of the ceramic insulator 2.

A circular columnar resistor 7 is disposed within the axial hole 4 between the center electrode 5 and the terminal electrode 6. Opposite end portions of the resistor 7 are electrically connected to the center electrode 5 and the terminal electrode 6 via conductive glass seal layers 8 and 9, respectively.

The metallic shell 3 is formed of a metal such as low-carbon steel and has a tubular shape. The metallic shell 3 has a threaded portion (externally threaded portion) 15 on its outer circumferential surface, and the threaded portion 15 is used to mount the spark plug 1 to a combustion apparatus, such as an internal combustion engine, a fuel cell reformer, or the like. A seat portion 16 projecting radially outward is formed on the outer circumferential surface and located rearward of the threaded portion 15. A ring-like gasket 18 is fitted to a screw neck 17 located at the rear end of the threaded portion 15. The metallic shell 3 also has a tool engagement portion 19 provided near its rear end. The tool engagement portion 19 has a hexagonal cross section and allows a tool such as a wrench to be engaged therewith when the metallic shell 3 is to be mounted to the combustion apparatus. Further, the metallic shell 3 has a crimp portion 20 which is provided at its rear end portion and is bent inward in the radial direction. In the present embodiment, the diameter of the metallic shell 3 is decreased so as to decrease the diameter of the spark plug 1. Therefore, the threaded portion 15 has a relatively small diameter (e.g., M12 or less). Therefore, the distance between the inner circumference surface of the forward end portion of the metallic shell 3 and the forward end of the ceramic insulator 2, measured in the direction perpendicular to the axis CL1, is relatively small (e.g., 1.0 mm or less), and the distance between the forward end portion of the metallic shell 3 and the forward end portion of the center electrode 5 is relatively small.

The metallic shell 3 has a tapered, stepped portion 21 provided on its inner circumferential surface and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear end opening portion of the metallic shell 3 is crimped radially inward; i.e., the crimp portion 20 is formed, whereby the ceramic insulator 2 is fixed to the metallic shell 3. An annular sheet packing 22 intervenes between the stepped portions 14 and 21 of the ceramic insulator 2 and the metallic shell 3. This retains gastightness of a combustion chamber and prevents leakage of a fuel gas to the exterior of the spark plug 1 through a clearance between the inner circumferential surface of the metallic shell 3 and the leg portion 13 of the ceramic insulator 2, which leg portion 13 is exposed to the combustion chamber.

In order to ensure gastightness which is established by crimping, annular ring members 23 and 24 intervene between the metallic shell 3 and the ceramic insulator 2 in a region near the rear end of the metallic shell 3, and a space between the ring members 23 and 24 is filled with powder of talc 25. That is, the metallic shell 3 holds the ceramic insulator 2 via the sheet packing 22, the ring members 23 and 24, and the talc 25.

A ground electrode 27 is joined to a forward end portion 26 of the metallic shell 3, and is bent, at its intermediate portion, such that a side surface of a distal end portion of the ground electrode 27 faces the forward end portion of the center electrode 5. A spark discharge gap 28 is formed between the forward end portion of the center electrode 5 and the distal end portion of the ground electrode 27. Spark discharge occurs at the spark discharge gap 28 in a direction generally parallel to the axis CL1.

Next, a method for manufacturing the spark plug 1 configured as mentioned above will be described.

First, the metallic shell 3 is formed beforehand. Specifically, a circular columnar metal material (e.g., an iron-based material or a stainless steel material) is subjected to cold forging or the like so as to form a general shape, and a through hole is then formed. Subsequently, machining is conducted so as to adjust the outline, thereby yielding a metallic-shell intermediate.

Subsequently, the ground electrode 27 formed of an Ni alloy and having the shape of a straight rod is resistance-welded to the forward end surface of the metallic-shell intermediate. The resistance welding is accompanied by formation of so-called "sags." After the "sags" are removed, the threaded portion 15 is formed in a predetermined region of the metallic-shell intermediate by rolling. Thus, the metallic shell 3 to which the ground electrode 27 has been welded is obtained. Notably, a rear end portion of the obtained metallic shell 3 has a cylindrical tubular shape (i.e., a state before formation of the crimp portion 20), and the thin wall portion between the seat portion 16 and the tool engagement portion 19 also has a cylindrical tubular shape.

The metallic shell 3 to which the ground electrode 27 has been welded is subjected to galvanization or nickel plating. In order to enhance corrosion resistance, the plated surface may be further subjected to chromate treatment.

Separately from preparation of the metallic shell 3, the ceramic insulator 2 is formed. Specifically, a granular material for molding is prepared by use of a material powder which contains alumina in a predominant amount, a binder, etc. By use of the prepared granular material for molding, a tubular green compact is formed by rubber press molding. The thus-formed green compact is subjected to grinding for shaping the obtained green compact. The shaped green compact is placed in a kiln, followed by firing, thereby yielding the ceramic insulator 2.

Separately from preparation of the metallic shell 3 and the ceramic insulator 2, the center electrode 5 is manufactured. Specifically, an Ni alloy prepared such that a copper alloy or the like is disposed in a central portion thereof for enhancing heat radiation is subjected to forging, thereby forming the center electrode 5.

Next, the ceramic insulator 2 and the center electrode 5, which are formed as mentioned above, the resistor 7, and the terminal electrode 6 are fixed in a sealed condition by means of the glass seal layers 8 and 9. In general, these glass seal layers 8 and 9 are formed of a mixture of borosilicate glass and metal powder. Specifically, the mixture is charged into the axial hole 4 of the ceramic insulator 2 such that the resistor 7 is sandwiched between layers of the mixture. Then, in a state in which the charged mixture is pressed by the terminal electrode 6 from the rear side, the resultant assembly is heated in a kiln so as to fire the mixture. In this heating process within the kiln, glaze applied to the surface of the rear trunk portion 10 of the ceramic insulator 2 may be simultaneously fired so as to form a glaze layer; alternatively, the glaze layer may be formed beforehand.

Subsequently, the thus-formed ceramic insulator 2 and the metallic shell 3 are fixed together through a talc pressing step and a crimping step.

Figure 2:
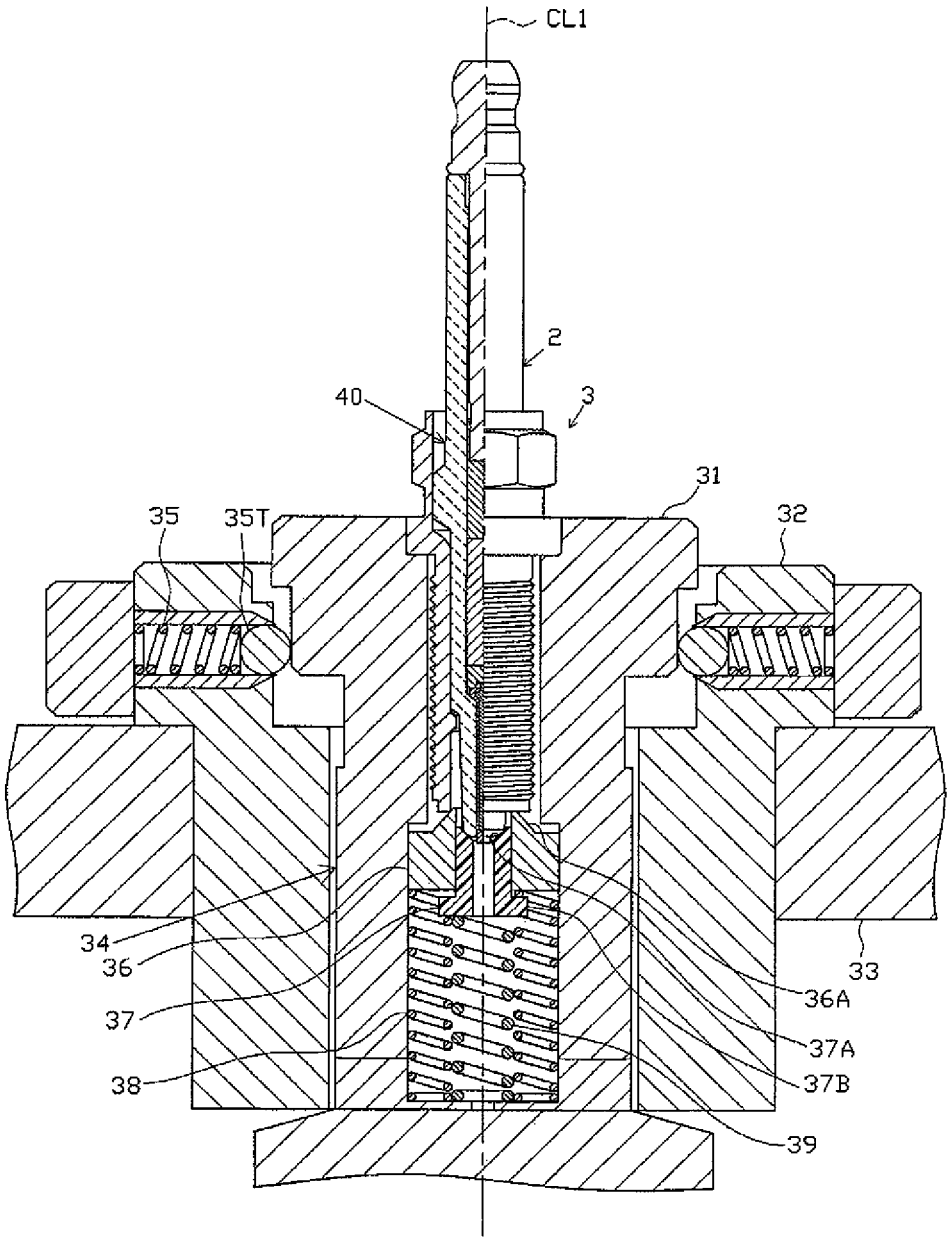
FIG. 2 is a partially sectioned front view showing the structures of a receiving member, a stationary base, etc.
Figure 3:
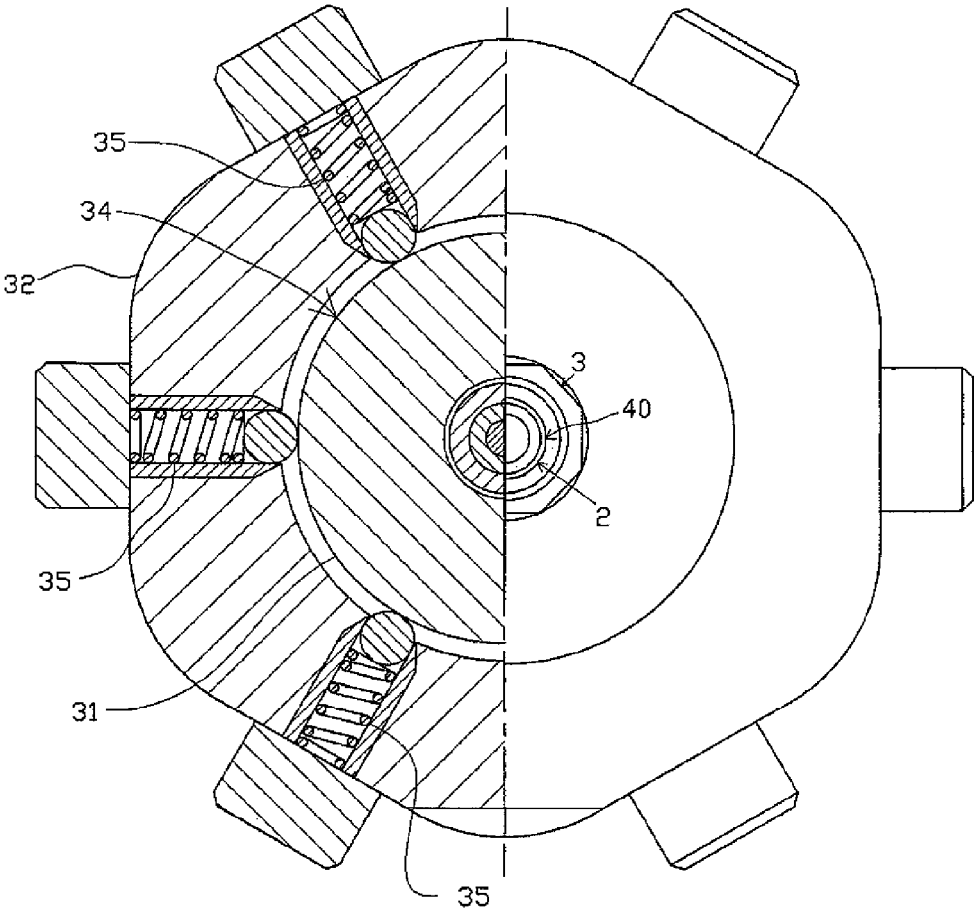
FIG. 3 is a partially sectioned plan view showing the structures of the receiving member, the stationary base, etc.

First, in the talc pressing step, as shown in FIG. 2, the metallic shell 3, into which the ceramic insulator 2 has been inserted, is supported by a tubular receiving member 31 formed of metal such that the axis CL1 extends in a direction generally parallel to the vertical direction. At that time, the metallic shell 3 is disposed such that its center axis coincides with the center axis of the receiving member 31. As shown in FIGS. 2 and 3, a tubular stationary base 32 is disposed around the receiving member 31, and the stationary base 32 is attached to a transfer table 33, which is movable in a predetermined transfer direction. An annular gap 34 is provided between the outer circumferential surface of the receiving member 31 and the inner circumferential surface of the stationary base 32 so that the receiving member 31 is movable in relation to the stationary base 32 in the radial direction of the receiving member 31. The receiving member 31 is supported by the stationary base 32 via a plurality of (six in the present embodiment) elastic members 35 provided between the receiving member 31 and the stationary base 32. The elastic members 35 are spring members extending toward the center axis of the stationary base 32. The elastic members 35 are disposed at positions symmetrical with respect to the center axis. A contact portion 35T of each elastic member 35 which comes into contact with the receiving member 31 has a spherical shape. Thus, the receiving member 31 is movable in the circumferential direction in relation to the stationary base 32. In the present embodiment, each elastic member 35 is disposed in a state in which it is compressed slightly from its natural length, and the receiving member 31 is supported by the stationary base 32 in a state in which it is urged toward the center axis of the receiving member 31. As a result, at least when the talc 25 is pressed by a talc pressing jig 41 to be described later and when the metallic shell 3 is pressed by a shell pressing jig 42 to be described later (i.e., when an external force is applied), the receiving member 31 can move in the radial direction thereof in relation to the talc pressing jig 41 or the shell pressing jig 42. Notably, each elastic member 35 may be disposed in a state in which it is extended slightly from the natural length. In this case, the receiving member 31 is disposed in a state in which it is pulled outward in the radial direction thereof.

A shell guide 36 and an insulator guide 37 each having a tubular shape are disposed in a lower region of the inner space of the receiving member 31.

The shell guide 36 is formed of a predetermined metallic material, and is urged upward by a second elastic member 38, which is disposed below the shell guide 36 and which can expand and contract in the vertical direction. Of the upper surface 36A of the shell guide 36, at least a portion on the side toward the inner periphery is tapered such that its height decreases gradually toward the outer periphery. When the metallic shell 3 is supported by the receiving member 31, the inner circumference of a forward end portion of the metallic shell 3 comes into contact with the tapered portion of the upper surface 36A. Since the forward end portion of the metallic shell 3 comes into contact with the upper surface 36A (the tapered portion thereof) of the shell guide 36 urged upward, the forward end portion of the metallic shell 3 is restrained from moving in the radial direction in relation to the receiving member 31. Notably, a recess (not shown) which can accommodate the ground electrode 27 is provided on the upper surface 36A of the shell guide 36. Therefore, when the metallic shell 3 is supported by the shell guide 36, the ground electrode 27 is accommodated in the recess.

The insulator guide 37, which is formed of a predetermined resin material, is inserted into the shell guide 36 such that the center axis of the insulator guide 37 coincides with the center axis of the shell guide 36. A third elastic member 39 which can expand and contract in the vertical direction is disposed below the insulator guide 37 so that the insulator guide 37 is urged upward by the third elastic member 39. The upper surface 37A of the insulator guide 37 is tapered such that its height increases gradually toward the outer periphery thereof. Thus, when the metallic shell 3 is supported by the receiving member 31, the outer circumference of the forward end portion of the ceramic insulator 2 comes into contact with the upper surface 37A. Since the forward end portion of the ceramic insulator 2 comes into contact with the upper surface 37A of the insulator guide 37 urged upward, the forward end portion of the ceramic insulator 2 is restrained from moving in the radial direction in relation to the receiving member 31. Notably, a projection portion 37B is provided at the lower end of the insulator guide 37 exposed from the shell guide 36. The projection portion 37B projects outward in the radial direction, and has an outer diameter greater than the inner diameter of the shell guide 36. The projection portion 37B determines the upper limit position of the insulator guide 37 in relation to the shell guide 36. Meanwhile, since the lower limit position of the insulator guide 37 in relation to the shell guide 36 can be adjusted to some degree, even when a plurality of types of spark plugs 1 which differ in the amount of projection of the forward end of the ceramic insulator 2 form the forward end of the metallic shell 3 are manufactured, the shell guide 36 and the insulator guide 37 can be used commonly among the different types of spark plugs. Since the outer circumferential surface of the shell guide 36 is in contact with the receiving member 31 with substantially no gap formed therebetween, the shell guide 36 and the insulator guide 37 cannot move in relation to the receiving member 31 in the radial direction. Accordingly, when the receiving member 31 moves in relation to the stationary base 32, the shell guide 36 and the insulator guide 37 move together with the receiving member 31.

Figure 4:
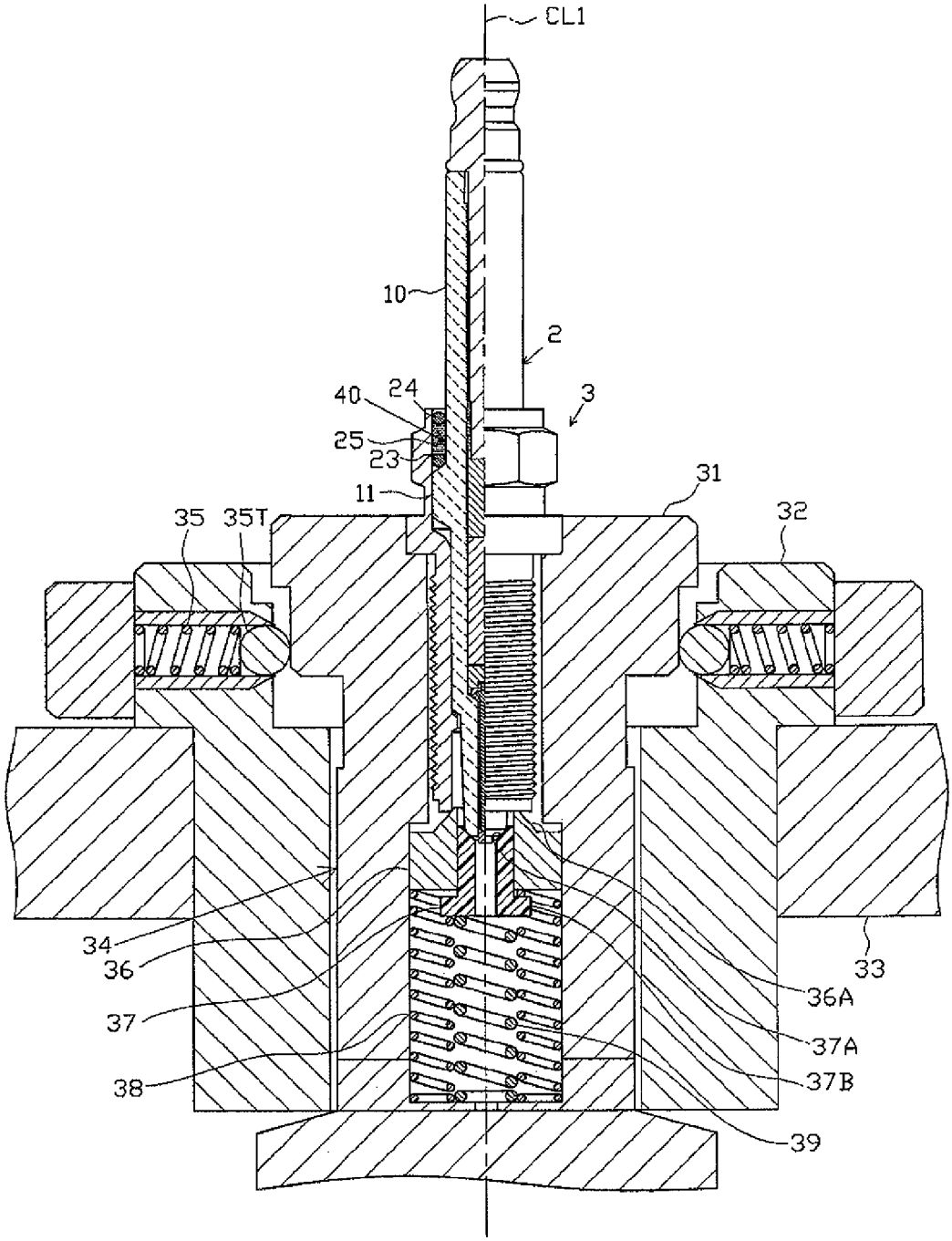
FIG. 4 is a partially sectioned front view for describing one substep of a talc pressing step.
Figure 5:
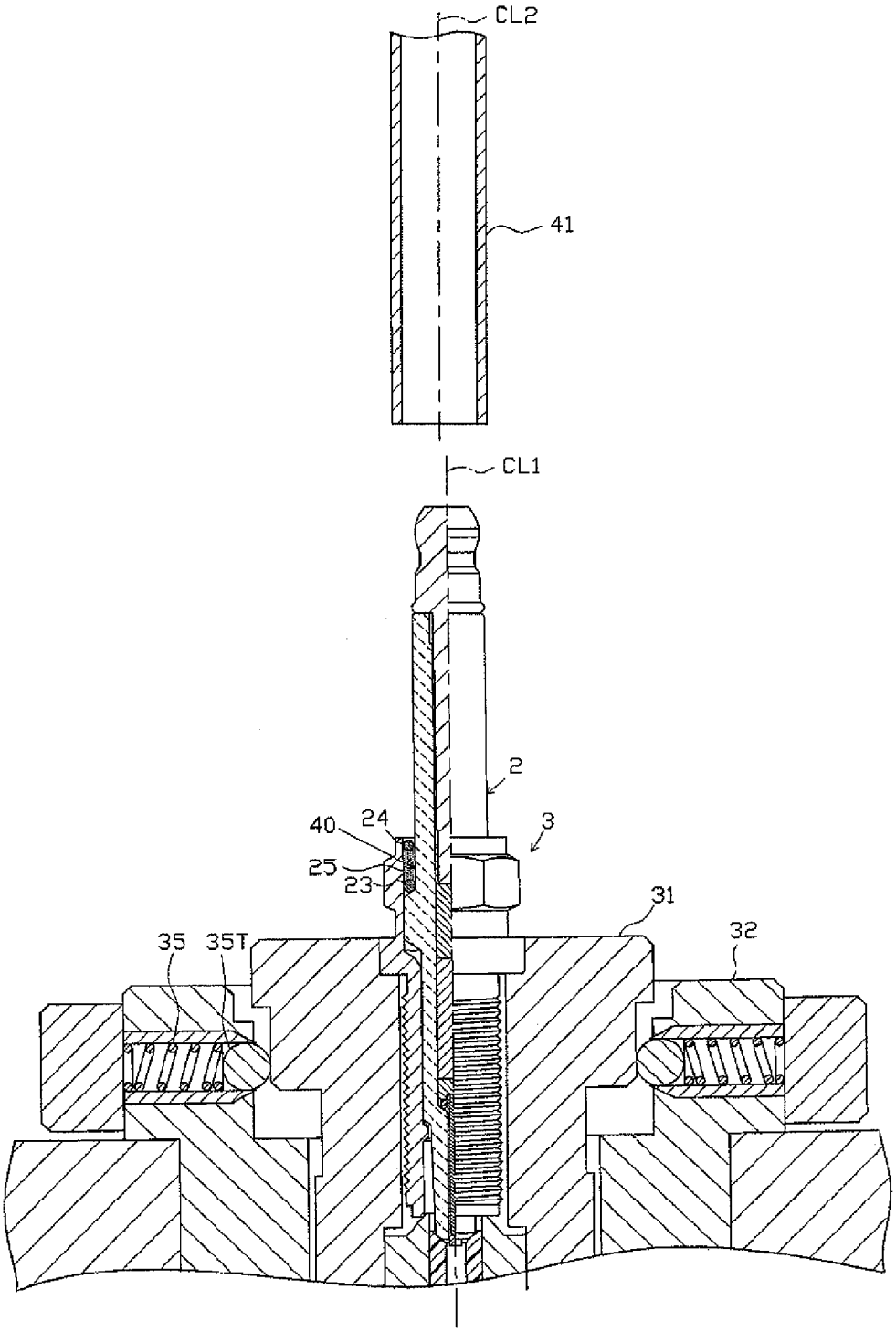
FIG. 5 is a partially sectioned front view for describing another substep of the talc pressing step.

Returning back to the description of the manufacturing method, after the metallic shell 3 is supported by the receiving member 31, as shown in FIG. 4, the ring member 23, the talc 25, and the ring member 24 are disposed in this sequence in an annular space 40 formed between the ceramic insulator 2 (the rear trunk portion 10 and the large-diameter portion 11) and the metallic shell 3. Subsequently, by moving the transfer table 33, as shown in FIG. 5, the metallic shell 3 is transferred to a position below the tubular talc pressing jig 41, which is movable along the direction of the axis CL1 (the vertical directions), and the transfer table 33 is stopped in a state in which the center axis CL2 of the talc pressing jig 41 approximately coincides with the center axis of the receiving member 31 (coinciding with the axis CL1) (in the present embodiment, in a state in which the center axis CL2 is slightly deviated from the axis CL1).

Figure 6:
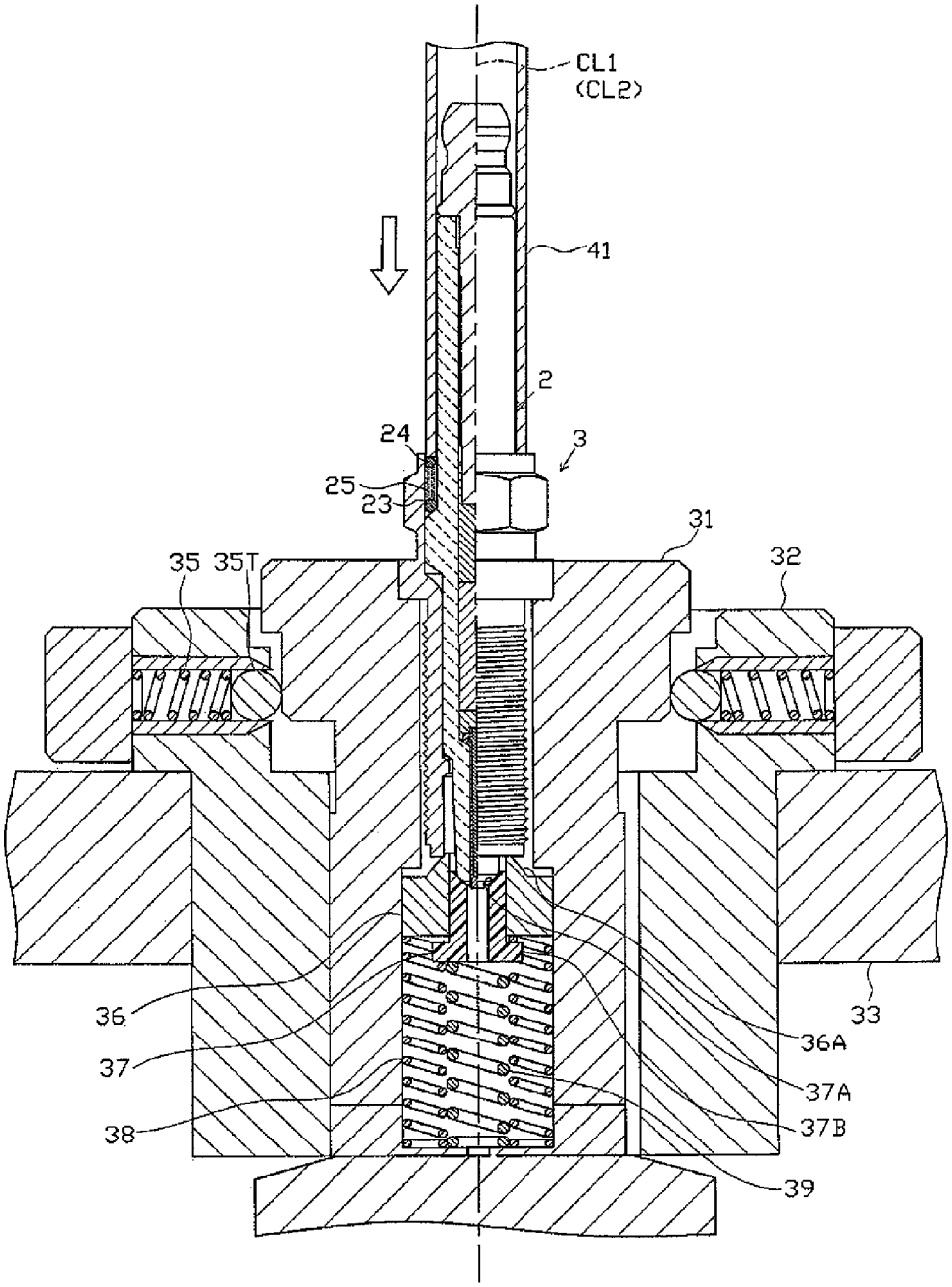
FIG. 6 is a partially sectioned front view for describing another substep of the talc pressing step.

Then, as shown in FIG. 6, the talc pressing jig 41 is moved downward so that the forward end portion of the talc pressing jig 41 presses the talc 25 via the ring member 24. Notably, the elastic members 35 hold the receiving member 31 such that the receiving member 31 does not move until at least a portion of the ceramic insulator 2 enters the inner space of the talc pressing jig 41. Also, when the talc pressing jig 41 moves downward and presses the talc 25, the receiving member 31 moves radially in relation to the talc pressing jig 41 (the stationary base 32) such that its center axis (coinciding with the axis CL1) coincides with the center axis CL2 of the talc pressing jig 41. Namely, the talc pressing step includes an eccentricity adjusting step (substep) of decreasing the eccentricity between the center axis CL2 of the talc pressing jig 41 and the axis CL1 of the ceramic insulator 2 in the radial direction.

Figure 7:
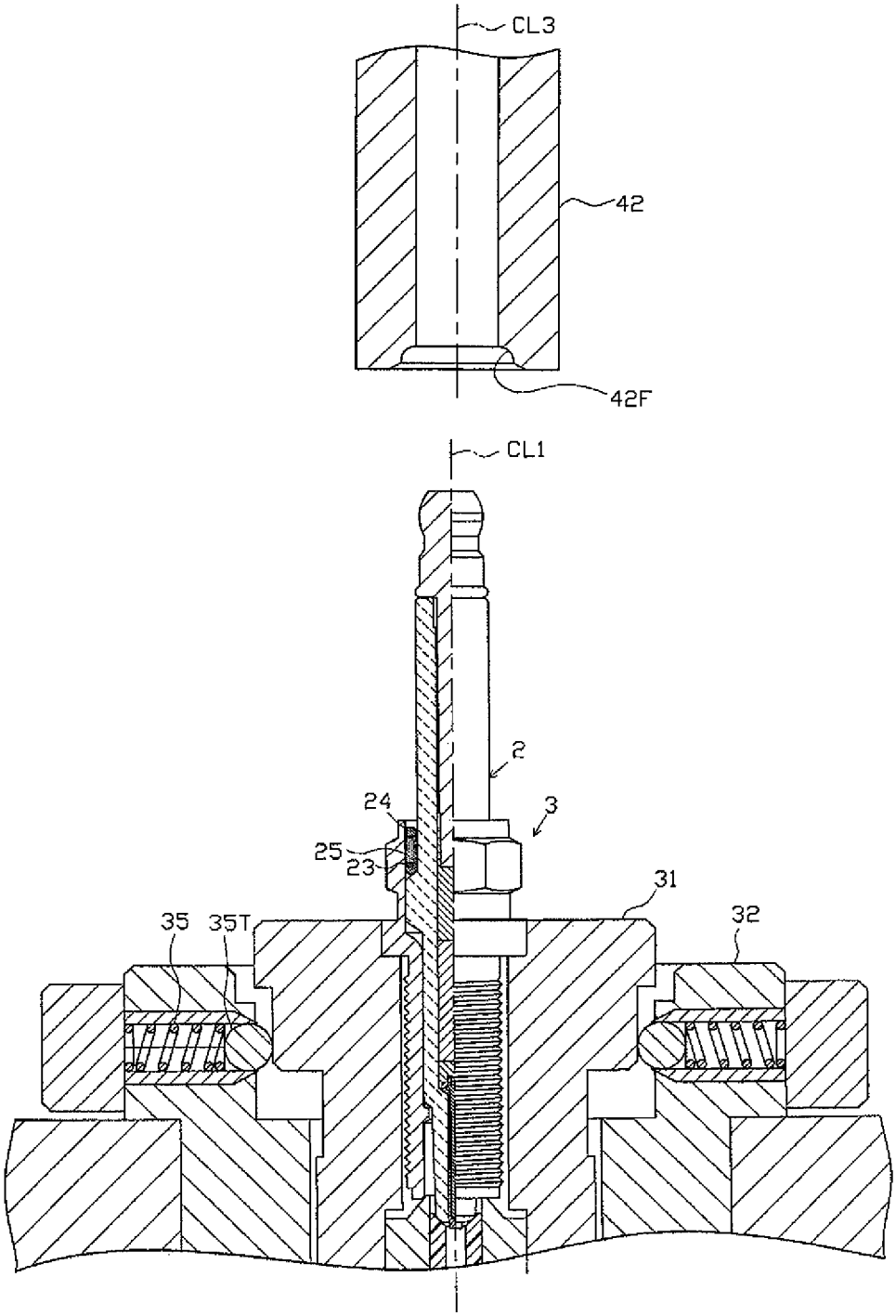
FIG. 7 is a partially sectioned front view for describing one substep of a crimping step.

After the talc pressing step, the metallic shell 3 is transferred to a position shown in FIG. 7 in order to perform the crimping step. Specifically, the metallic shell 3 is transferred to a position below the shell pressing jig 42, which is movable along the direction of the axis CL1 (the vertical directions), and the transfer table 33 is stopped in a state in which the center axis CL3 of the shell pressing jig 42 approximately coincides with the center axis of the receiving member 31 (the axis CL1) (in the present embodiment, in a state in which the center axis CL3 is slightly deviated from the axis CL1). Notably, the shell pressing jig 42 has a crimp forming portion 42F which is formed on the inner circumferential surface thereof and a curved shape corresponding to the shape of the crimp portion 20.

Figure 8:
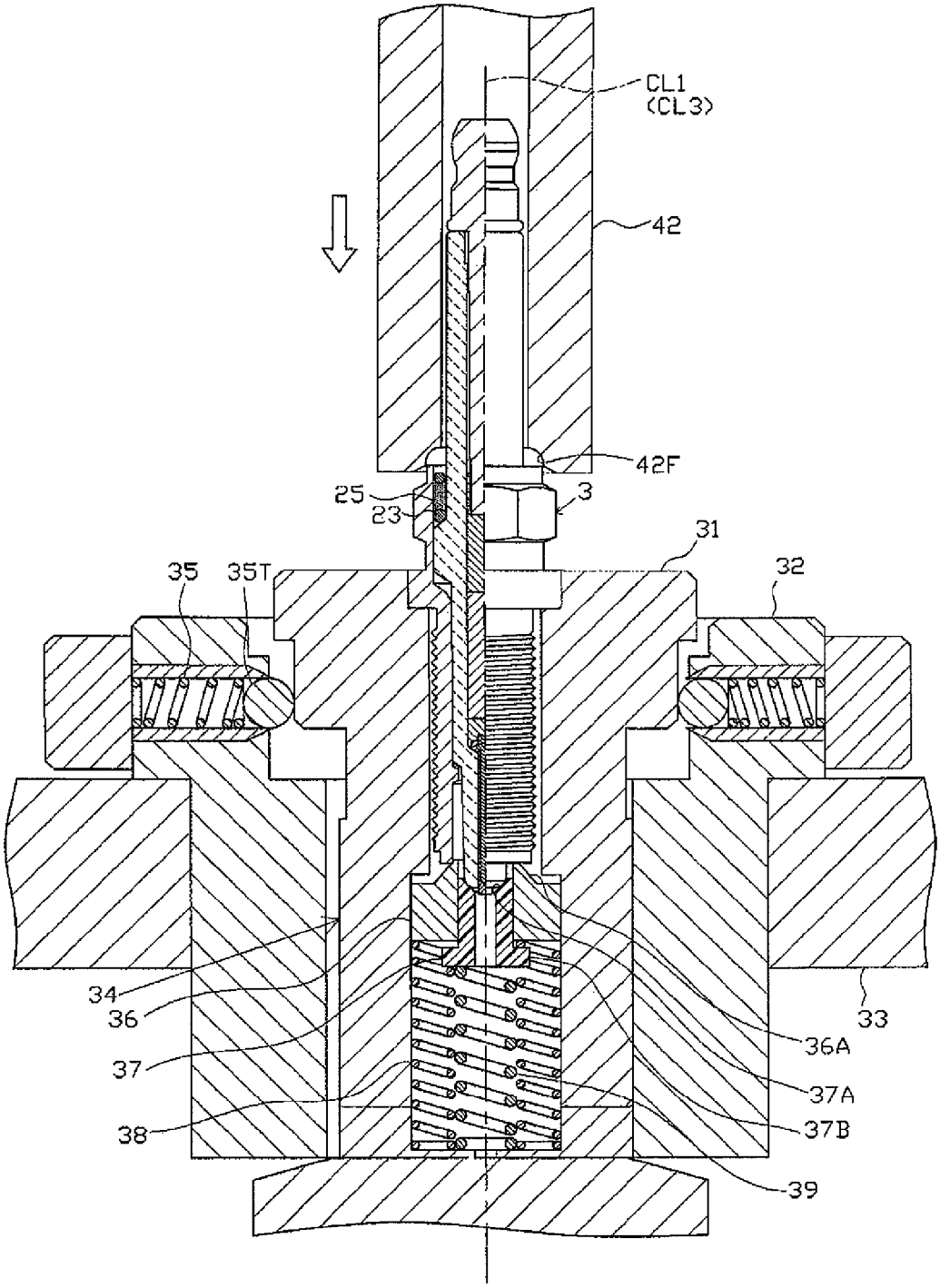
FIG. 8 is a partially sectioned front view for describing another substep of the crimping step.
Figure 9:
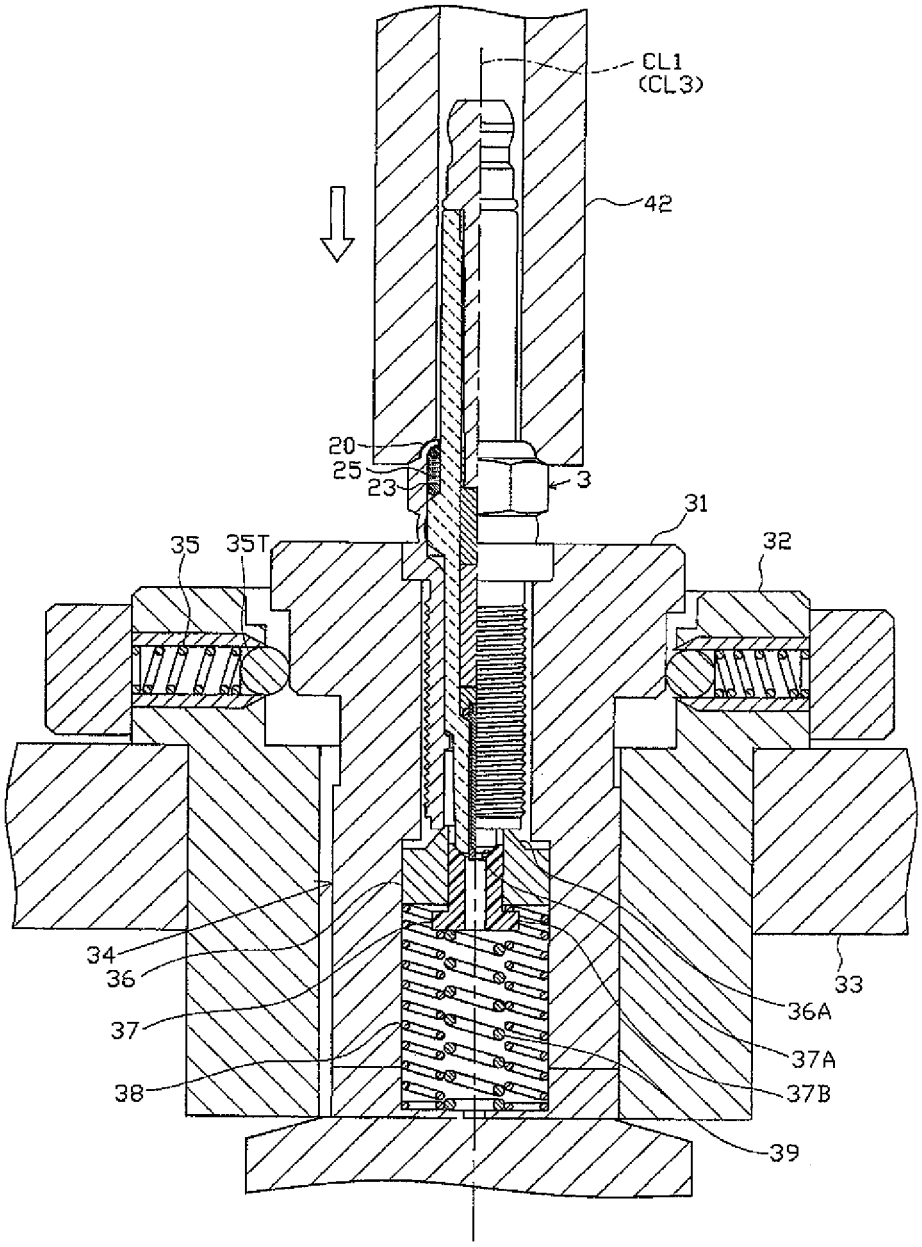
FIG. 9 is a partially sectioned front view for describing another substep of the crimping step.

After the metallic shell 3 is disposed at a predetermined position, as shown in FIG. 8, the shell pressing jig 42 is moved downward so as to bring the crimp forming portion 42F into contact with the rear end portion of the metallic shell 3 and apply a pressing force to the rear end portion of the metallic shell 3 along the direction of the axis CL1. As a result, as shown in FIG. 9, the thin wall portion between the seat portion 16 and the tool engagement portion 19 bulges outward in the radial direction, and the rear end opening portion of the metallic shell 3 is bent inward in the radial direction, whereby the crimp portion 20 is formed. As a result, the ceramic insulator 2 and the metallic shell 3 are fixed together. Notably, in the crimping step, the elastic members 35 hold the receiving member 31 such that the receiving member 31 does not move until at least a portion of the ceramic insulator 2 enters the inner space of the shell pressing jig 42. Also, as in the case of the talc pressing step, when the shell pressing jig 42 moves downward, the receiving member 31 moves radially in relation to the shell pressing jig 42 (the stationary base 32) such that its center axis (coinciding with the axis CL1) coincides with the center axis CL3 of the shell pressing jig 42. Namely, the crimping step includes an eccentricity adjusting step (substep) of decreasing the eccentricity between the center axis CL3 of the shell pressing jig 42 and the axis CL1 of the ceramic insulator 2 in the radial direction.

In the present embodiment, the forward end portion of the ceramic insulator 2 is held by the insulator guide 37 in both the talc pressing step and the crimping step; however, the talc pressing step or the crimping step may be performed without holding the forward end portion of the ceramic insulator 2. Also, the receiving member 31, which is movable in relation to the stationary base 32, may be used in either one of the talc pressing step and the crimping step (that is, only one of the talc pressing step and the crimping step includes the eccentricity adjusting step (substep)).

After the ceramic insulator 2 and the metallic shell 3 are fixed together, the ground electrode 27 is bent toward the center electrode 5, and the size of the spark discharge gap 28 between the center electrode 5 and the ground electrode 27 is adjusted, whereby the above-described spark plug 1 is obtained.

As having been described in detail, according to the present embodiment, the annular gap 34 is formed between the outer circumferential surface of the receiving member 31 and the inner circumferential surface of the stationary base 32 so that the receiving member 31, which supports the metallic shell 3, is radially movable in relation to the pressing jig 41 (42). Accordingly, even in the case where a slight misalignment is present between the center axis CL2 (CL3) of the pressing jig 41 (42) and the axis CL1 of the ceramic insulator 2 when the talc pressing step or the crimping step is performed, through relative movement of the receiving member 31 in relation to the pressing jig 41 (42), the center axis CL2 (CL3) of the pressing jig 41 (42) is accurately aligned with the axis CL1 of the ceramic insulator 2. Accordingly, when the talc 25 is pressed, the radially inward force applied to the outer circumferential surface of the ceramic insulator 2 via the talc 25 becomes uniform along the circumferential direction of the ceramic insulator 2. Also, when the crimp portion 20 is formed, the radially inward force applied to the outer circumferential surface of the metallic shell 3 becomes uniform along the circumferential direction of the metallic shell 3. As a result, the misalignment and/or inclination between the axis CL1 of the ceramic insulator 2 and the center axis of the metallic shell 3 can be effectively suppressed, whereby breakage of the ceramic insulator 2 and generation of anomalous discharge can be more reliably prevented.

Also, since the receiving member 31 is supported on the stationary base 32 via the elastic members 35, unless an external force acts on the receiving member 31, the receiving member 31 and the stationary base 32 basically maintain the fixed positional relation therebetween. Namely, even when the receiving member 31 moves in relation to the stationary base 32 at the time of pressing of the talc 25 or formation of the crimp portion 20, the receiving member 31 returns to its original position after that. Accordingly, the operation of aligning the center axis CL2 (CL3) of the pressing jig 41 (42) with the axis CL1 of the ceramic insulator 2 does not influence a talc pressing step or crimping step which is subsequently performed.

Further, in the talc pressing step and the crimping step, the insulator guide 37 restrains radial movement of the forward end portion of the ceramic insulator 2 in relation to the receiving member 31. Accordingly, the axis CL1 of the ceramic insulator 2 can be aligned with the center axis of the metallic shell 3 supported by the receiving member 31 very accurately, whereby the misalignment and/or inclination between the axis CL1 of the ceramic insulator 2 and the center axis of the metallic shell 3 can be more effectively suppressed. In particularly, since the misalignment or the like is suppressed considerably effectively at the forward end portion of the ceramic insulator 2, generation of anomalous discharge can be more reliably prevented. In addition, through use of the receiving member 31, which is movable in relation to the stationary base 32, it becomes possible to reduce the stress acting on the ceramic insulator 2 in the talc pressing step and the crimping step although the forward end portion of the ceramic insulator 2 is held. Thus, it is possible to more reliably prevent breakage of the ceramic insulator 2, which breakage would otherwise occur when the forward end portion of the ceramic insulator 2 is held.

In addition, in the talc pressing step and the crimping step, the receiving member 31 is held not to move until at least a portion of the ceramic insulator 2 enters the inner space of the pressing jig 41 (42). Accordingly, occurrence of a situation in which the axis CL1 of the ceramic insulator 2 greatly deviates from the center axis CL2 (CL3) of the pressing jig 41 (42) can be more reliably prevented, and collision of the pressing jig 41 (42) with the ceramic insulator 2 or the terminal electrode 6 can be prevented. As a result, damage to the ceramic insulator 2 or the terminal electrode 6 can be more reliably prevented.

Notably, in the case of the spark plug 1 which is relatively small in the distance L (in the direction perpendicular to the axis CL1) between the inner circumferential surface of the front end portion of the metallic shell 3 and the forward end portion of the ceramic insulator 2 as in the present embodiment, anomalous discharge such as lateral spark becomes more likely to occur between the center electrode 5 and the metallic shell 3 if the axis CL1 of the ceramic insulator 2 (the center axis of the center electrode 5) slightly deviates from or inclines in relation to the center axis of the metallic shell 3. Namely, compared with a spark plug which is relatively large in the above-described distance L, in the spark plug 1 of the present embodiment, the misalignment or inclination of the axis CL1 is more likely to influence its ignition performance. However, since the misalignment and inclination of the axis CL1 can be effectively suppressed through application of the present invention, generation of anomalous discharge can be effectively prevented even in the spark plug 1, which is relatively small in the above-mentioned distance L and has a possibility of generating anomalous discharge due to the misalignment or inclination of the axis CL1. In other words, the present invention is particularly effective for manufacture of spark plugs which are relatively small in the above-mentioned distance L.

Figure 10:
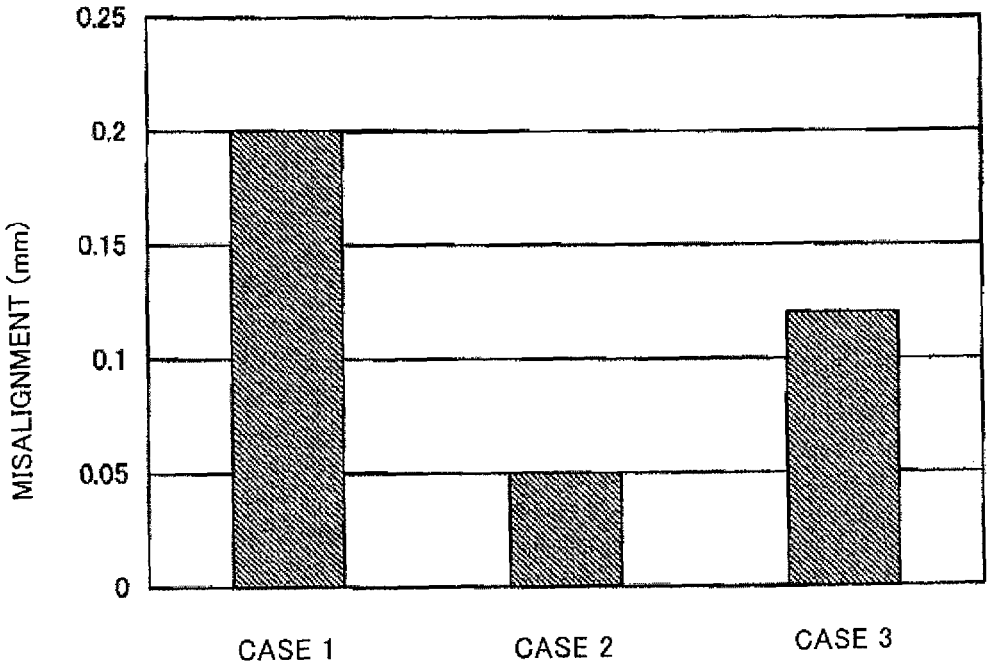
FIG. 10 is a graph showing the results of an alignment accuracy evaluation test.

Next, an alignment accuracy evaluation test was carried out in order to check the action and effects provided by the above-described embodiment. The outline of the alignment accuracy evaluation test is as follows. Namely, in the talc pressing step, the metallic shell was disposed below the talc pressing jig such that a misalignment of 0.4 mm was produced between the center axis of the talc pressing jig and the axis of the ceramic insulator. The talc was pressed by the talc pressing jig in such a state, and the obtained spark plug was measured so as to determine the misalignment between the axis of the ceramic insulator and the center axis of the metallic shell as viewed from the forward end side with respect to the direction of the axis. In the alignment accuracy evaluation test, the above-described misalignment was measure for a case (case 1) where the metallic shell was supported by a receiving member (stationary receiving member) fixed to the stationary base in an immovable state; a case (case 2) where the forward end portion of the ceramic insulator was held by an insulator guide and the metallic shell was supported by the stationary support; and a case (case 3) where the metallic shell was supported by a receiving member (movable receiving member) which was movable in relation to the talc pressing jig (the stationary base) in the radial direction of the receiving member. FIG. 10 shows the results of the test.

Figure 11:
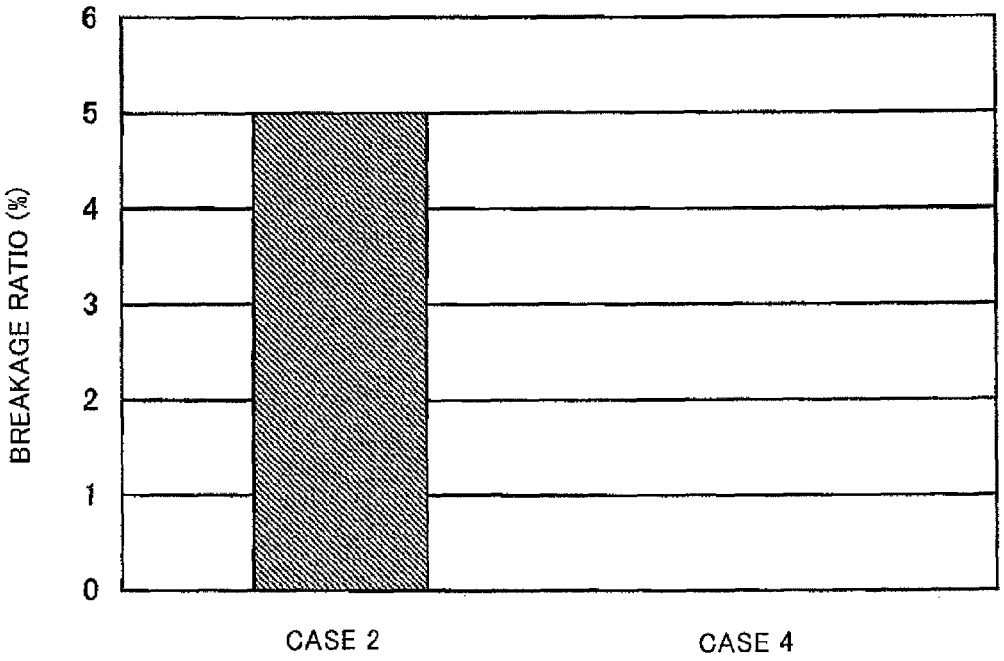
FIG. 11 is a graph showing the ratio of breakage of a ceramic insulator for the case where a movable receiving member is used and the case where a stationary receiving member is used.

Also, a test in which the talc was pressed with a misalignment of 0.4 mm produced between the center axis of the talc pressing jig and the axis of the ceramic insulator was performed, as in the above-described test, a plurality of time for a case where the forward end portion of the ceramic insulator was held by the insulator guide and the metallic shell was supported by the stationary receiving member (similar to the above-described case 2) and a case (case 4) where the forward end portion of the ceramic insulator was held by the insulator guide and the metallic shell was supported by the movable support. The obtained spark plugs were observed so as to check whether or not the forward end portion of the ceramic insulator was broken or damaged as a result of the pressing of the talc, and the ratio of occurrence of breakage (breakage ratio) was calculated. FIG. 11 shows the breakage ratio for both the cases.

It was found that, as shown in FIG. 10, although the misalignment was relatively large in the case (case 1) where the metallic shell was supported by the stationary receiving member without holding the forward end portion of the ceramic insulator, the misalignment was sufficiently small in the case (case 3) where the metallic shell was supported by the movable support. Conceivably, the misalignment became sufficiently small for the following reason. Since the receiving member was made movable in relation to the stationary base, in the talc pressing step, the receiving member moved such that its center axis (the axis of the ceramic insulator) coincided with the center axis of the talc pressing jig. As a result, the radially inward force applied to the ceramic insulator when the talc was pressed became approximately uniform along the circumferential direction of the ceramic insulator.

Also, it was found that, although the misalignment was very small in the case (case 2) where the metallic shell was supported by the stationary receiving member and the forward end portion of the ceramic insulator was held, as shown in FIG. 11, breakage of the ceramic insulator became more likely to occur. Conceivably, breakage of the ceramic insulator became more likely to occur for the following reason. Since the talc was pressed in a state in which the center axis of the talc pressing jig was not aligned with the axis of the ceramic insulator, a large stress acted on the held ceramic insulator in the radial direction In contrast, it was found that, in the case (case 4) where the metallic shell was supported by the movable receiving member and the forward end portion of the ceramic insulator was held, in the talc pressing step, breakage of the ceramic insulator was suppressed quite effectively. Conceivably, this is because the receiving member moved when the talc was pressed, whereby the radial stress acting on the ceramic insulator decreased sufficiently.

The above-described test results demonstrate that, in order to prevent the misalignment and/or inclination between the axis of the ceramic insulator and the center axis of the metallic shell, it is preferred that the movable receiving member, which is movable in relation to the talc pressing jig (the stationary base) in the radial direction, is used in the talc pressing step, and it is more preferred that the insulator guide for holding the forward end portion of the ceramic insulator is used in the talc pressing step. However, in the case where the insulator guide is used, it is necessary to use the movable receiving member in order to prevent breakage of the ceramic insulator.

Notably, the effect of suppressing the misalignment, etc. through use of the movable receiving member may be expected in any step in which a tubular pressing jig is moved along the direction of the axis so as to press the metallic shell or the talc (the ceramic insulator). Accordingly, the misalignment between the axis of the ceramic insulator and the center axis of the metallic shell or the like assembly error can be prevented through use of the movable receiving member not only in the talc pressing step but also in the crimping step in which the rear end portion of the metallic shell is pressed by the shell pressing jig so as to form the crimp portion of the metallic shell. Also, even in the crimping step, the misalignment, etc. can be prevented more effectively by holding the forward end portion of the ceramic insulator.

Figure 12:
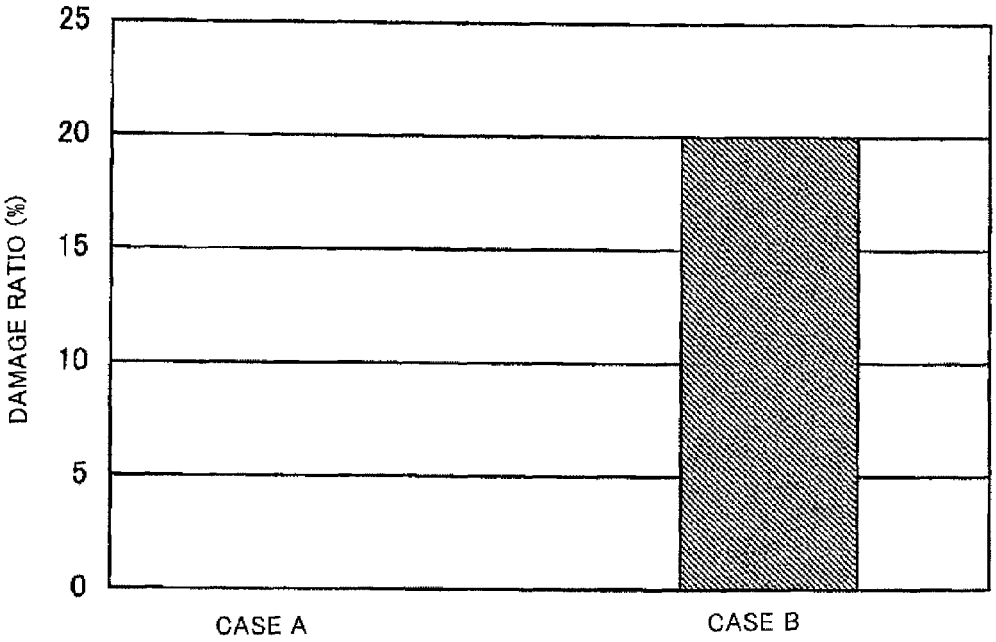
FIG. 12 is a graph showing the ratio of damage to a terminal electrode for cases A and B.

Next, a test of pressing the talc was carried out a plurality of times for a case (case A) where the receiving member was held until at least a portion of the ceramic insulator entered the inner space of the talc pressing jig and a case (case B) where the receiving member was not held such that the receiving member was freely movable during movement of the talc pressing jig. For each case, the ratio at which the electrode terminal was damaged (damage ratio) was measured. FIG. 12 shows the results of this test.

It was found that, as shown in FIG. 12, in case B, the terminal electrode was damaged in some cases. In contrast, in case A, damage to the terminal electrode was more reliably prevented. Conceivably, damage to the terminal electrode was prevented for the following reason. Since the receiving member was held until at least a portion of the ceramic insulator entered the inner space of the talc pressing jig, the axis of the ceramic insulator was more reliably prevented from greatly deviating from the center axis of the talc pressing jig. Thus, collision of the talc pressing jig with the terminal electrode was suppressed.

The above-described test results demonstrate that, in order to more reliably prevent damage to the terminal electrode in the talc pressing step, it is preferred to hold the receiving member until at least a portion of the ceramic insulator enters the inner space of the talc pressing jig. Notably, in the case where the outer diameter of the terminal electrode is smaller than the outer diameter of the rear end portion of the ceramic insulator, the talc pressing jig may come into contact with the rear end portion of the ceramic insulator and damage the ceramic insulator. However, such damage to the ceramic insulator can be prevented by holding the receiving member until at least a portion of the ceramic insulator enters the inner space of the talc pressing jig.

Similarly, in the crimping step, in which the pressing jig is moved along the direction of the axis as in the case of the talc pressing step, damage to the terminal electrode and the ceramic insulator can be prevented by holding the receiving member until at least a portion of the ceramic insulator enters the inner space of the shell pressing jig.

The present invention is not limited to the details of the above-described embodiment, and may be practiced as follows. Needless to say, other application examples and modifications which are not illustrated below are also possible.

(a) In the above-described embodiment, the receiving member 31 is supported on the stationary base 32 via the elastic members 35, and the gap 34 is provided between the receiving member 31 and the stationary base 32. Thus, when the talc 25 (the metallic shell 3) is pressed by the pressing jig 41 (42), the receiving member 31 is made movable in relation to the pressing jig 41 (42) and is held until at least a portion of the ceramic insulator 2 enters the inner space of the pressing jig 41 (42).

Figure 13:
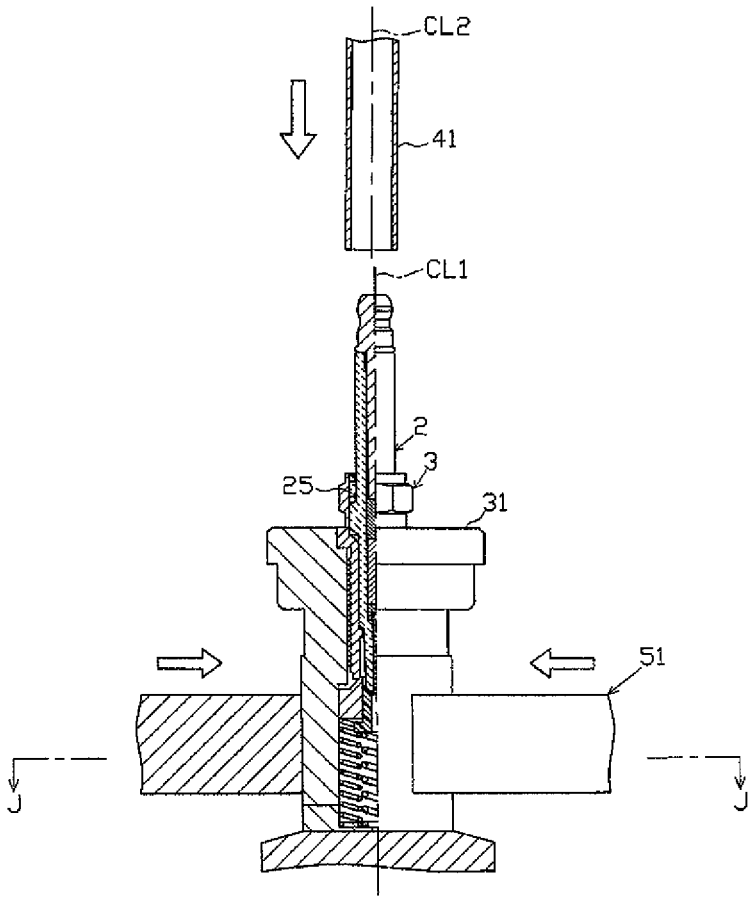
FIG. 13(*a*) is a partially sectioned front view for describing the structures of a receiving member and a holding device used in the talc pressing step in another embodiment, and FIG. 13(*b*) is a sectional view taken along line J-J in FIG. 13(*a*).
Figure 13:
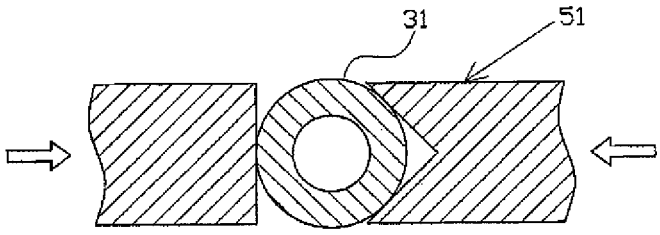
Figure 14:
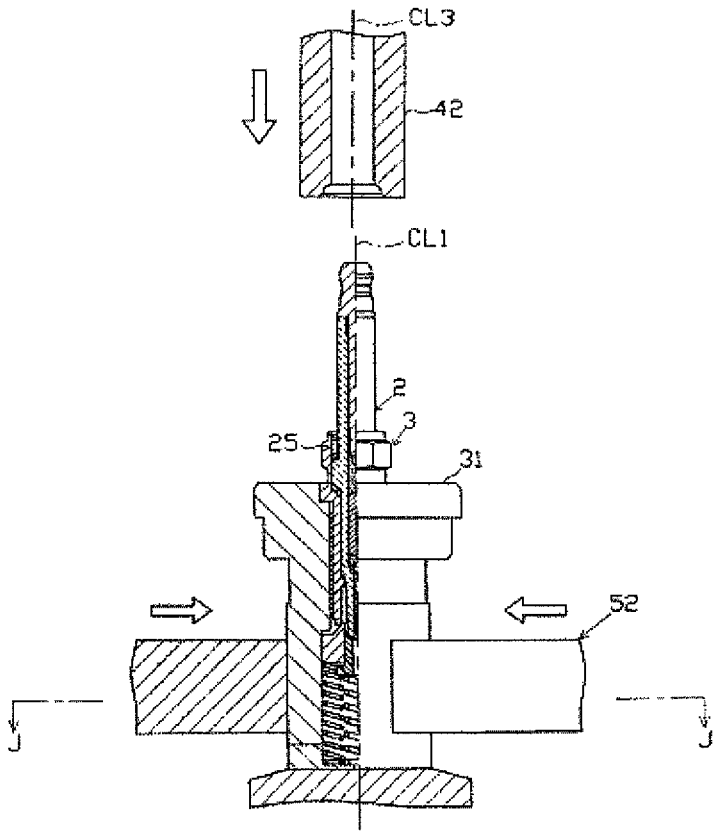
FIG. 14(*a*) is a partially sectioned front view for describing the structures of a receiving member and a holding device used in the crimping step in another embodiment, and FIG. 14(*b*) is a sectional view taken along line J-J in FIG. 14(*a*).
Figure 14:
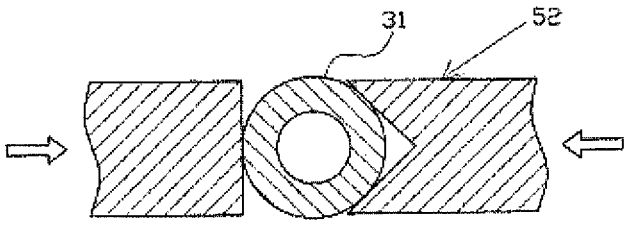
Figure 15:
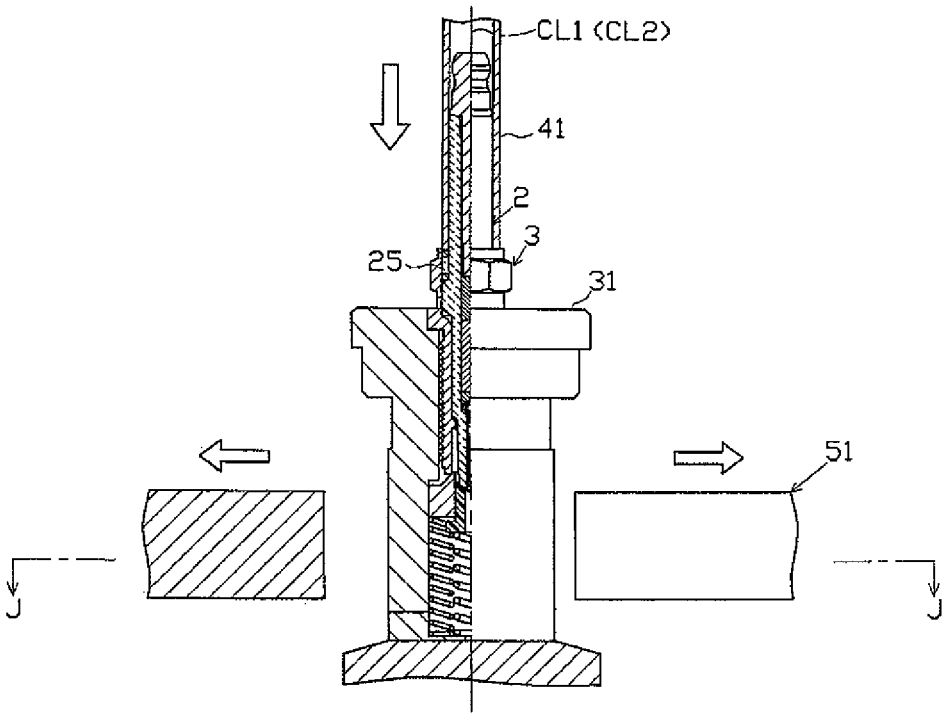
FIG. 15(*a*) is a partially sectioned front view for describing one substep of the talc pressing step in another embodiment, and FIG. 15(*b*) is a sectional view taken along line J-J in FIG. 15(*a*).
Figure 15:
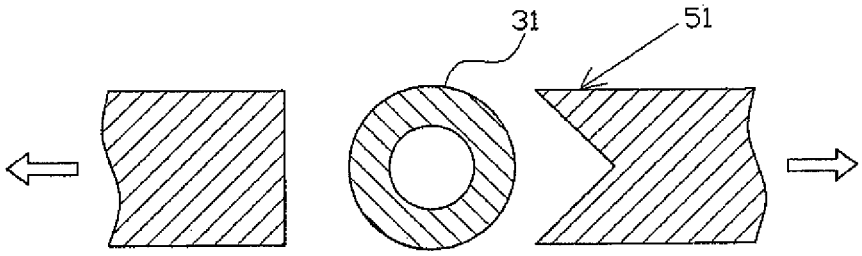
Figure 16:
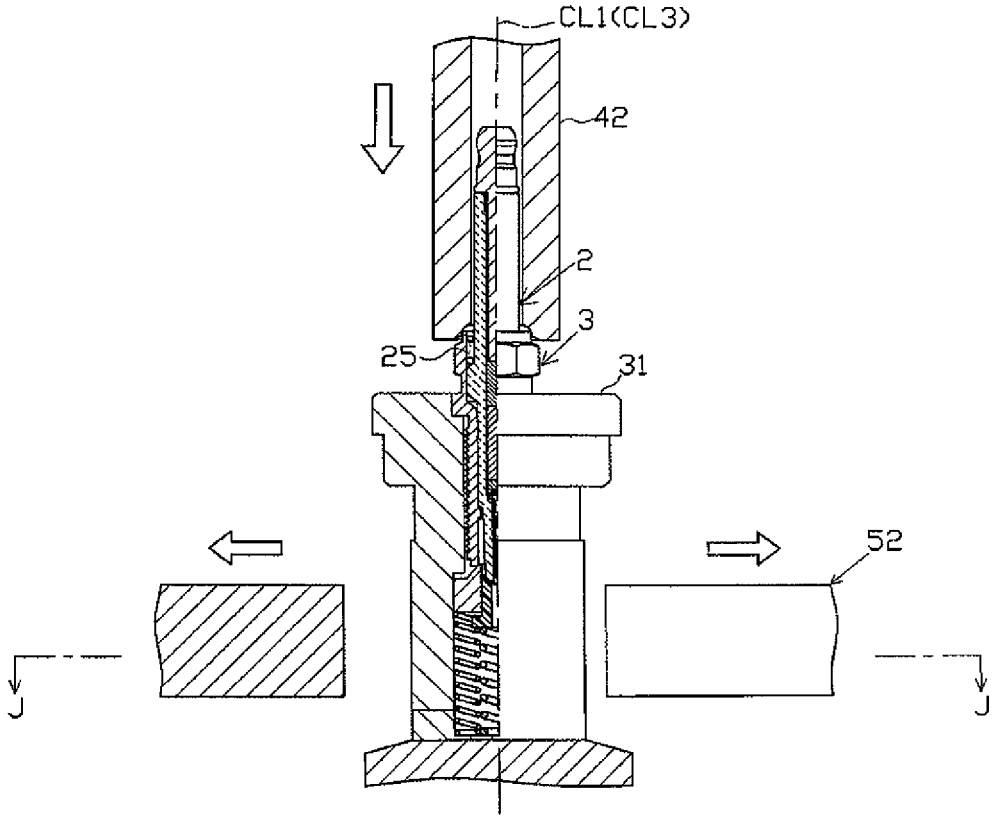
FIG. 16(*a*) is a partially sectioned front view for describing one substep of the crimping step in another embodiment, and FIG. 16(*b*) is a sectional view taken along line J-J in FIG. 16(*a*).
Figure 16:
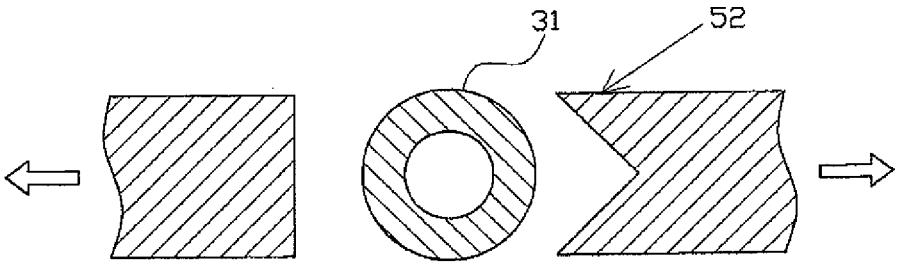

However, the above-described embodiment may be modified as follows. As shown in FIGS. 13(*a*) and 13(*b*) and FIGS. 14(*a*) and 14(*b*), until at least a portion of the ceramic insulator 2 enters the inner space of the pressing jig 41, 42, the receiving member 31 is held by holding devices 51 and 52 (e.g., air cylinders or the like), which are disposed to sandwich the outer circumferential surface of the receiving member 31 and can come into contact with and separate from the receiving member 31. As shown in FIGS. 15(*a*) and 15(*b*) and FIGS. 16(*a*) and 16(*b*), when the talc 25 or the metallic shell 3 is pressed, the holding of the receiving member 31 by the holding device 51, 52 is cancelled so as to enable the receiving member 31 to move in relation to the pressing jig 41, 42.

Figure 17:
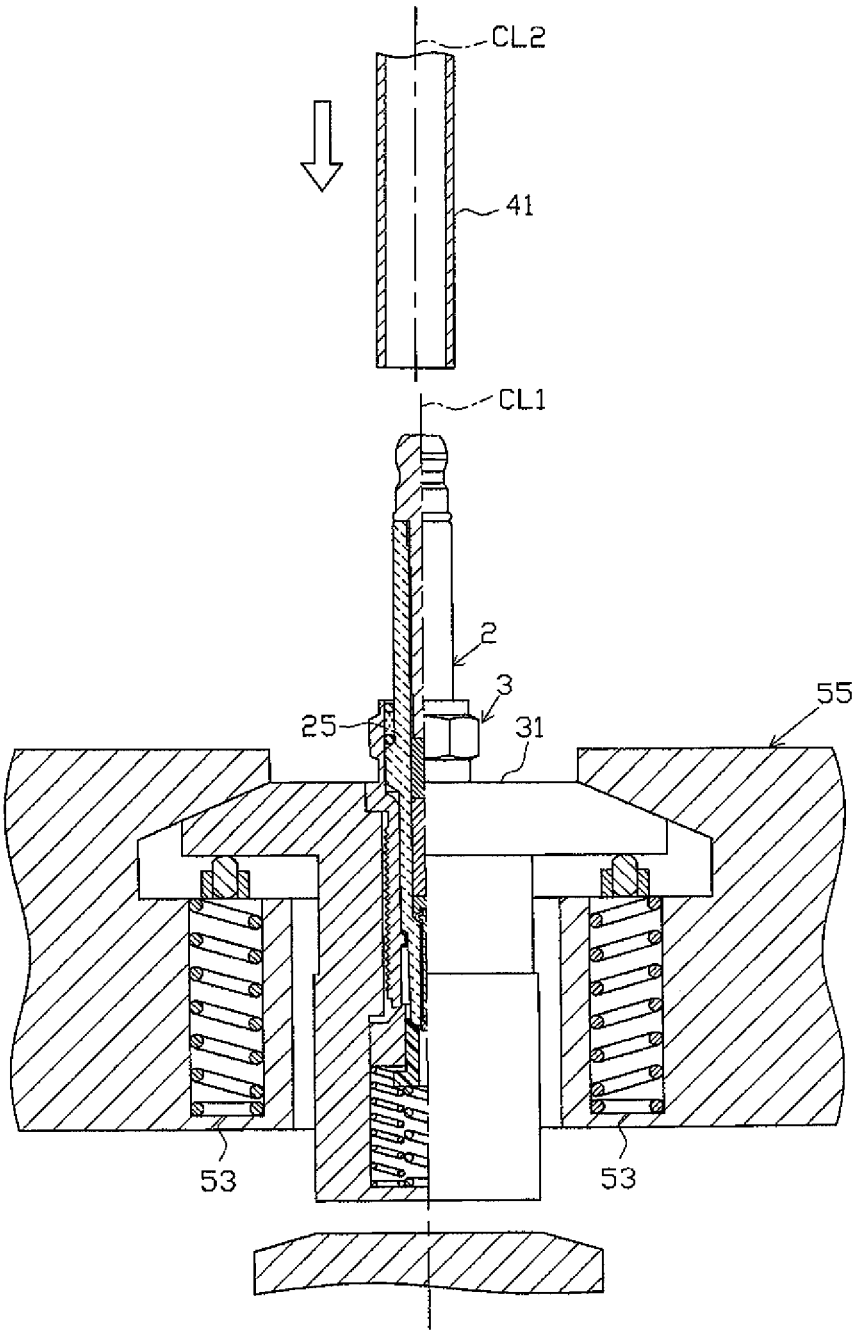
FIG. 17 is a partially sectioned front view for describing the structures of a receiving member and a holding device used in the talc pressing step in another embodiment.
Figure 18:
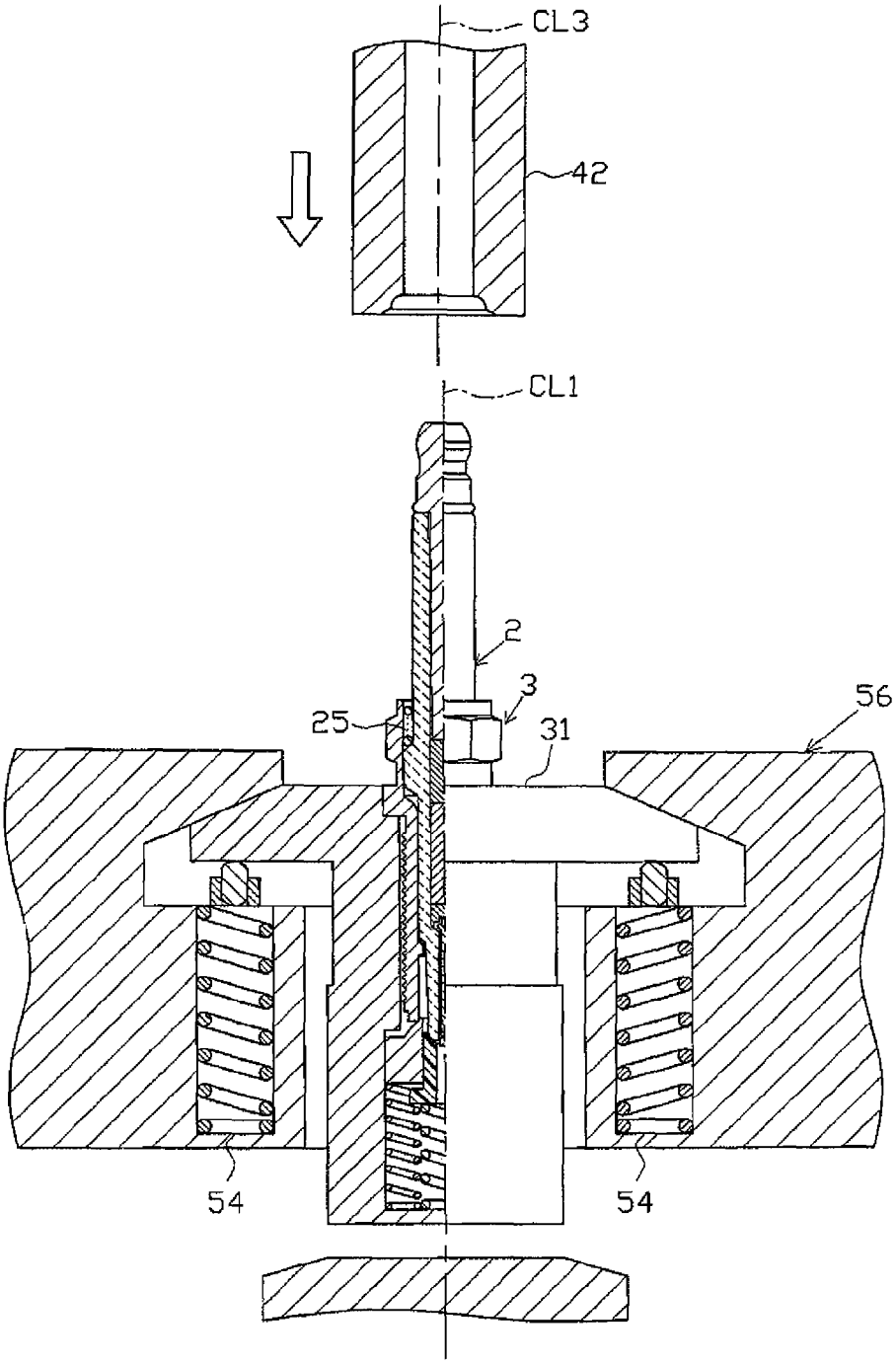
FIG. 18 is a partially sectioned front view for describing the structures of a receiving member and a holding device used in the crimping step in another embodiment.
Figure 19:
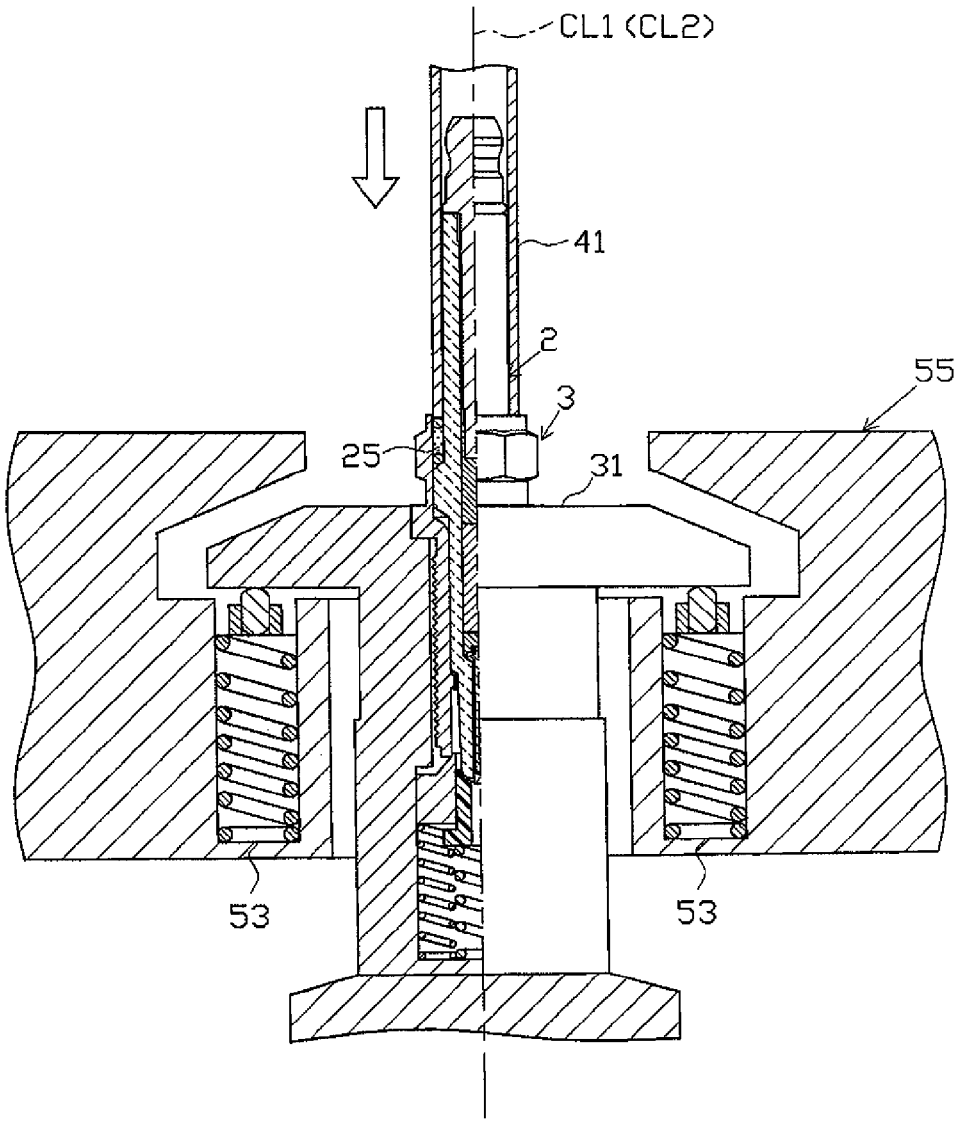
FIG. 19 is a partially sectioned front view for describing one substep of the talc pressing step in another embodiment.
Figure 20:
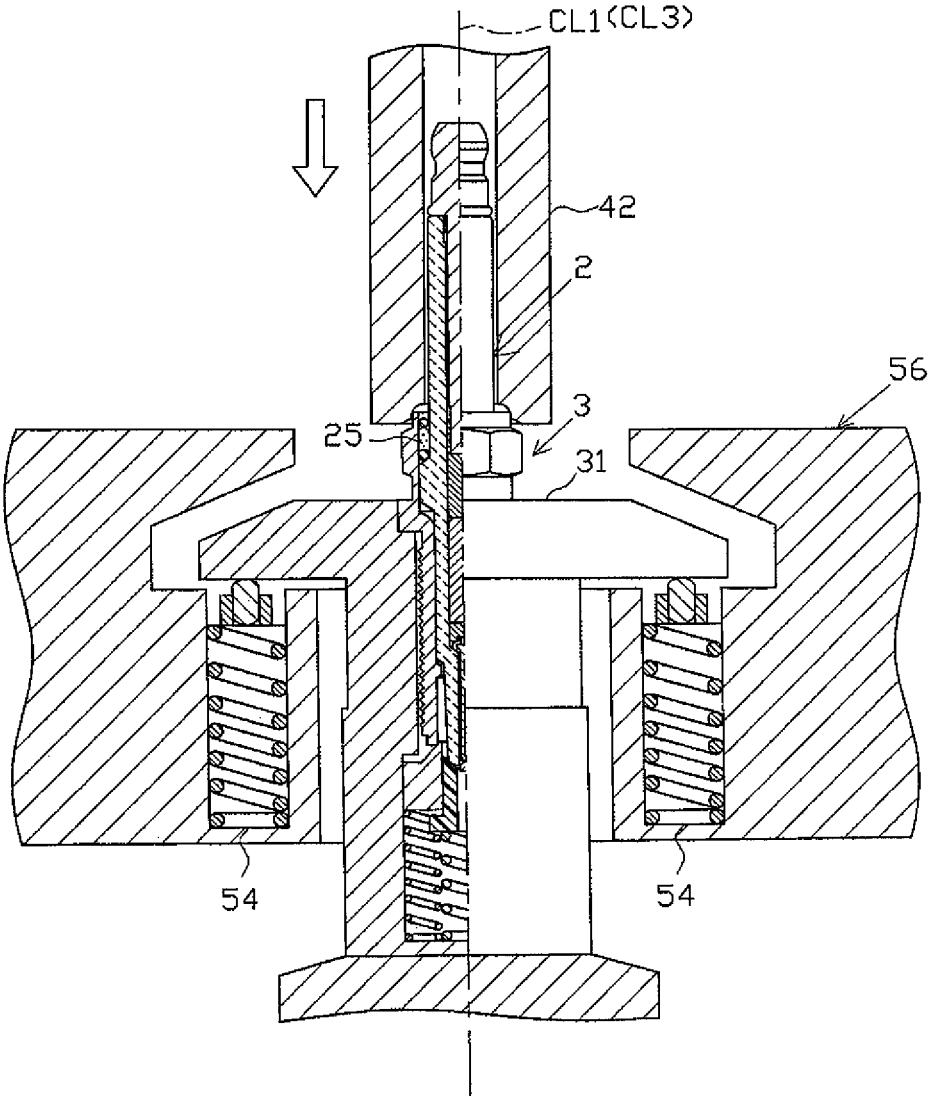
FIG. 20 is a partially sectioned front view for describing one substep of the crimping step in another embodiment.

Also, a receiving member 31 as shown in FIGS. 17 and 18 may be used. This receiving member 31 is supported by a plurality of elastic members 53, 54 extending in the vertical direction. By the urging forces from the elastic members 53, 54, the receiving member 31 is urged to come into contact with a holding device 55, 56 provided above the periphery of the receiving member 31, whereby the receiving member 31 is held. Meanwhile, when the receiving member 31 separates from the holding device 55, 56 as a result of its downward movement, the receiving member 31 becomes movable in relation to the pressing jig 41, 42 in the radial direction. Specifically, until at least a portion of the ceramic insulator 2 enters the inner space of the pressing jig 41, 42, due to the urging forces from the elastic members 53, 54, the receiving member 31 is in contact with the holding device 55, 56, whereby the receiving member 31 is held. Meanwhile, when the talc 25 or the metallic shell 3 is pressed, as shown in FIGS. 19 and 20, due to the pressing force of the pressing jig 41, 42, the elastic members 53, 54 are compressed and deformed, whereby the receiving member 31 separates from the holding device 55, 56. Thus, the receiving member 31 becomes movable in relation to the pressing jig 41, 42 in the radial direction.

In these cases as well, the misalignment and/or inclination between the axis CL1 of the ceramic insulator 2 and the center axis of the metallic shell 3 can be effectively suppressed, and damage to the ceramic insulator 2 and the terminal electrode 6 caused by contact with the pressing jig 41, 42 can be more reliably prevented.

(b) In the spark plug 1 of the above-described embodiment, the diameter of the metallic shell 3 is relatively small, and, therefore, the above-mentioned distance L is relatively small. However, no particular limitation is imposed on spark plugs which can be manufactured by the present invention. For example, the present invention may be employed for manufacture of a spark plug in which the screw diameter of the metallic shell 3 is greater than M12 and the above-mentioned distance L is relatively large.

(c) In the embodiment described above, the ground electrode 27 is joined to the front end portion 26 of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(d) In the embodiment described above, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF REFERENCE NUMERALS

1: spark plug
2: ceramic insulator (insulator)
3: metallic shell
20: crimp portion
25: talc
31: support
32: stationary base
34: gap
35: elastic member
41: talc pressing jig
42: shell pressing jig
CL1: axis (of the ceramic insulator)
CL2: center axis (of the talc pressing jig)
CL3: center axis (of the shell pressing jig)

The invention claimed is:

1. A method for manufacturing a spark plug comprising: a tubular insulator extending in the direction of an axis; a tubular metallic shell provided around the insulator; and talc charged between the insulator and the metallic shell, the method comprising:

a talc pressing step of pressing the talc along the direction of the axis using a tubular talc pressing jig in a state in which the metallic shell having the insulator inserted thereinto is supported by a tubular receiving member, wherein the receiving member is made movable in relation to the talc pressing jig in the radial direction of the receiving member at least when the talc is pressed by the talc pressing jig; and the talc pressing step including an eccentricity adjusting step of reducing an eccentricity between a center axis of the talc pressing jig and the axis of the insulator in the radial direction.

2. A method for manufacturing a spark plug according to claim 1, wherein the receiving member is supported by a stationary base disposed around the receiving member, via a plurality of elastic members provided between the receiving member and the stationary base; and an annular gap is formed between an outer circumferential surface of the receiving member and an inner circumferential surface of the stationary base such that the receiving member is movable in relation to the stationary base in the radial direction of the receiving member.

3. A method for manufacturing a spark plug according to claim 1, wherein in the spark plug, the insulator and the metallic shell are fixed together by a crimp portion provided at a rear end portion of the metallic shell and bent inward in the radial direction said method further comprises:

a crimping step which is performed after the talc pressing step so as to press the rear end portion of the metallic shell along the direction of the axis using a tubular shell pressing jig to thereby form the crimp portion, wherein, in the crimping step, the crimp portion is formed through use of the shell pressing jig in a state in which the metallic shell having the insulator inserted thereinto is supported by the receiving member, which is made movable in relation to the shell pressing jig in the radial direction of the receiving member at least when the metallic shell is pressed by the shell pressing jig.

4. A method for manufacturing a spark plug according to claim 3, wherein, in the crimping step, a forward end portion of the insulator is held so as to restrain radial movement of the forward end portion of the insulator in relation to the receiving member.

5. A method for manufacturing a spark plug according to claim 3, wherein, in the crimping step, the receiving member is held until at least a portion of the insulator enters an inner space of the shell pressing jig.

6. A method for manufacturing a spark plug according to claim 1, wherein, in the talc pressing step, a forward end portion of the insulator is held so as to restrain radial movement of the forward end portion of the insulator in relation to the receiving member.

7. A method for manufacturing a spark plug according to claim 1, wherein, in the talc pressing step, the receiving member is held until at least a portion of the insulator enters an inner space of the talc pressing jig.

8. A method for manufacturing a spark plug according to claim 7, wherein, in the crimping step, the receiving member is held until at least a portion of the insulator enters an inner space of the shell pressing jig.

9. A method for manufacturing a spark plug comprising: a tubular insulator extending in the direction of an axis; a tubular metallic shell provided around the insulator; and the insulator and the metallic shell being fixed together by a crimp portion provided at a rear end portion of the metallic shell and bent inward in the radial direction, the method comprising:

a crimping step of pressing the rear end portion of the metallic shell along the direction of the axis using a tubular shell pressing jig in a state in which the metallic shell having the insulator inserted thereinto is supported by a tubular receiving member, wherein the receiving member is made movable in relation to the shell pressing jig in the radial direction of the receiving member at least when the metallic shell is pressed by the shell pressing jig; and the crimping step includes an eccentricity adjusting step of reducing an eccentricity between a center axis of the shell pressing jig and the axis of the insulator in the radial direction.

10. A method for manufacturing a spark plug according to claim 9, wherein the receiving member is supported by a stationary base provided around the receiving member, via a plurality of elastic members provided between the receiving member and the stationary base; and an annular gap is formed between an outer circumferential surface of the receiving member and an inner circumferential surface of the stationary base such that the receiving member is movable in relation to the stationary base in the radial direction of the receiving member.

11. A method for manufacturing a spark plug according to claim 10, wherein, in the crimping step, the receiving member is held until at least a portion of the insulator enters an inner space of the shell pressing jig.

12. A method for manufacturing a spark plug according to claim 9 wherein, in the crimping step, a forward end portion of the insulator is held so as to restrain radial movement of the forward end portion of the insulator in relation to the receiving member.

13. A device for manufacturing a spark plug comprising a tubular insulator extending in the direction of an axis; a tubular metallic shell provided around the insulator; and talc charged between the insulator and the metallic shell, the device comprising:

a tubular receiving member for supporting the metallic shell; and a tubular talc pressing jig which is movable along the direction of the axis, wherein the talc is pressed by moving the talc pressing jig in a state in which the metallic shell having the insulator inserted thereinto is supported by the receiving member; and the receiving member is made movable in relation to the talc pressing jig in the radial direction of the receiving member at least when the talc is pressed by the talc pressing jig.

14. A device for manufacturing a spark plug according to claim 13, further comprising:

a stationary base disposed around the receiving member; and a plurality of elastic members provided between the receiving member and the stationary base, wherein an annular gap is formed between an outer circumferential surface of the receiving member and an inner circumferential surface of the stationary base such that the receiving member is movable in relation to the stationary base in the radial direction of the receiving member.

15. A device for manufacturing a spark plug according to claim 13, wherein, when the talc pressing jig is moved, the receiving member is held until at least a portion of the insulator enters an inner space of the talc pressing jig.

16. A device for manufacturing a spark plug according to claim 13, wherein in the spark plug, the insulator and the metallic shell are fixed together by a crimp portion provided at a rear end portion of the metallic shell and bent inward in the radial direction; and the manufacturing device further comprises a tubular shell pressing jig which is movable in the direction of the axis, wherein, in a state in which the metallic shell having the insulator inserted thereinto is supported by the receiving member, the shell pressing jig is moved so as to press the rear end portion of the metallic shell to thereby form the crimp portion; and the receiving member is made movable in relation to the shell pressing jig in the radial direction of the receiving member at least when the metallic shell is pressed by the shell pressing jig.

17. A device for manufacturing a spark plug according to claim 13, said device further comprising:

an insulator guide which holds a forward end portion of the insulator so as to restrain radial movement of the forward end portion of the insulator in relation to the receiving member.

18. A device for manufacturing a spark plug comprising a tubular insulator extending in the direction of an axis; a tubular metallic shell provided around the insulator; and the insulator and the metallic shell being fixed together by a crimp portion provided at a rear end portion of the metallic shell and bent inward in the radial direction, the device comprising:

a tubular receiving member for supporting the metallic shell; and a tubular shell pressing jig which is movable along the direction of the axis, wherein, in a state in which the metallic shell having the insulator inserted thereinto is supported by the receiving member, the shell pressing jig is moved so as to press the rear end portion of the metallic shell to thereby form the crimp portion; and the receiving member is made movable in relation to the shell pressing jig in the radial direction of the receiving member at least when the metallic shell is pressed by the shell pressing jig.

19. A device for manufacturing a spark plug according to claim 18, the device further comprising:

a stationary base disposed around the receiving member; and a plurality of elastic members provided between the receiving member and the stationary base, wherein an annular gap is formed between an outer circumferential surface of the receiving member and an inner circumferential surface of the stationary base such that the receiving member is movable in relation to the stationary base in the radial direction of the receiving member.

20. A device for manufacturing a spark plug according to claim 18, wherein, when the shell pressing jig is moved, the receiving member is held until at least a portion of the insulator enters an inner space of the shell pressing jig.

21. A device for manufacturing a spark plug according to claim 18, said device further comprising:

an insulator guide which holds a forward end portion of the insulator so as to restrain radial movement of the forward end portion of the insulator in relation to the receiving member.

* * * * *